US007028616B2

(12) United States Patent
Hirano et al.

(10) Patent No.: US 7,028,616 B2
(45) Date of Patent: Apr. 18, 2006

(54) INK SUPPLY AMOUNT CONTROL METHOD AND APPARATUS FOR PRINTING PRESS

(75) Inventors: Masahiro Hirano, Ibaraki (JP); Toshikazu Tomita, Ibaraki (JP)

(73) Assignee: Komori Corporation, Tokyo (JP)

( * ) Notice: Subject to any disclaimer, the term of this patent is extended or adjusted under 35 U.S.C. 154(b) by 331 days.

(21) Appl. No.: 10/736,975

(22) Filed: Dec. 15, 2003

(65) Prior Publication Data

US 2004/0125156 A1 Jul. 1, 2004

(30) Foreign Application Priority Data

Dec. 26, 2002 (JP) ..... 2002-376597

(51) Int. Cl.
*B41F 31/02* (2006.01)

(52) U.S. Cl. ..... 101/365; 101/351.1; 101/352.01

(58) Field of Classification Search ..... 101/365, 101/DIG. 47, 483, 484, 485, 351.1, 351.2, 101/351.3, 351.4, 352.01, 352.02, 352.03, 101/352.04, 352.05

See application file for complete search history.

(56) References Cited

U.S. PATENT DOCUMENTS 5,845,576 A 12/1998 Junghans
6,112,660 A 9/2000 Junghans et al.
6,378,429 B1 * 4/2002 Tomita et al. ..... 101/365
6,810,810 B1 * 11/2004 Anweiler et al. ..... 101/484
6,915,737 B1 * 7/2005 Hirano et al. ..... 101/100
6,975,430 B1 * 12/2005 Tomita ..... 358/1.9
2001/0037740 A1 11/2001 Mayer et al.

FOREIGN PATENT DOCUMENTS

| | | |
|---|---|---|
| EP | 0 983 852 | 3/2000 |
| EP | 1 080 891 | 3/2001 |
| EP | 1080891 A | 3/2001 |
| JP | 05-147200 A | 6/1993 |
| JP | 05147200 | 6/1993 |

* cited by examiner

*Primary Examiner*—Andrew H. Hirshfeld
*Assistant Examiner*—Leo T. Hinze
(74) *Attorney, Agent, or Firm*—Blakely Sokoloff Taylor & Zafman

(57) ABSTRACT

In an ink supply amount control method for a printing press, the number of ink fountain keys whose gap amount with respect to an ink fountain roller falls within a predetermined range is counted. On the basis of the count value, the swing operation of an ink ductor roller which is arranged in an ink supply path and swings in synchronism with rotation of the printing press is controlled. Ink is supplied from the gap between the plurality of ink fountain keys and the ink fountain roller to the ink supply path in accordance with rotation of the ink fountain roller at the time of printing. The ink is supplied to a printing plate attached to a plate cylinder through the ink supply path by the swing operation of the ink ductor roller. An ink supply amount control apparatus and a printing press are also disclosed.

19 Claims, 18 Drawing Sheets

INK SUPPLY AMOUNT CONTROL METHOD AND APPARATUS FOR PRINTING PRESS

BACKGROUND OF THE INVENTION

The present invention relates to ink supply amount control for a printing press and, more particularly to an ink supply amount control method and apparatus which can suppress any density variation in a printing product with a small image area by intermittently stopping swing (ink feed operation) of an ink ductor roller.

Generally, the ink supply amount to a printing plate in a printing press is controlled by a gap amount between an ink fountain key and an ink fountain roller. FIG. 14 shows the main part of an ink supply apparatus (inker) provided in a printing unit for each color (ink color) in a rotary printing press. Referring to FIG. 14, an ink fountain 1 stores ink 2. An ink fountain roller 3 supplies the ink from the ink fountain 1 to the ink supply path. A plurality of ink fountain keys 4 (4-1 to **4-*n*) are juxtaposed in the axial direction of the ink fountain roller 3. An ink ductor roller 5 is arranged in the ink supply path to supply the ink from the ink fountain keys 4 to ink rollers 6. A printing plate 7 is attached to the outer surface of a plate cylinder 8. The ink is supplied from the ink rollers 6 including an ink distribution roller 6-1 and ink form rollers 6-2 to the printing plate 7**.

In a four-color rotary printing press shown in FIG. 15, a printing unit 9 for each color individually has the ink supply apparatus shown in FIG. 15.

In the printing press having the above arrangement, the ink in the ink fountain 1 is supplied to the ink fountain roller 3 through the gap between the ink fountain keys 4 and the ink fountain roller 3 as the ink fountain roller 3 rotates. When the ink ductor roller 5 swings, the ink supplied to the ink fountain roller 3 is transferred to the ink ductor roller 5. The ink transferred to the ink ductor roller 5 is transferred to the ink distribution roller 6-1. The ink 2 transferred to the ink roller 6-1 is distributed by the ink rollers 6 and then supplied to the printing plate 7 through the ink form rollers 6-2. The ink supplied to the printing plate 7 is printed on a printing paper sheet through a blanket cylinder (not shown).

The gap amount (opening ratio of the ink fountain keys 4-1 to **4-*n*) between the ink fountain keys 4-1 to 4-*n* and the ink fountain roller 3 is set in accordance with the image area ratio in each of areas of the printing plate 7, which correspond to the ink fountain keys 4-1 to 4-*n*, respectively. For example, the set values of the opening ratios of the ink fountain keys 4-1 to 4-*n* are obtained in accordance with a preset "image area ratio—ink fountain key opening ratio conversion curve", and the opening ratios of the ink fountain keys 4-1 to 4-*n* are adjusted. The value of the rotation amount (feed amount) of the ink fountain roller 3 is defined in advance. The opening ratios of the ink fountain keys 4-1 to 4-*n* and the feed amount of the ink fountain roller 3 are set for the printing unit 9** of each color.

In the ink supply apparatus in each printing unit 9, the ink ductor roller 5 reciprocally swings between the ink fountain roller 3 and the ink roller 6-1 to transfer the ink from the ink fountain roller 3 to the ink roller 6-1. The reciprocal operation (ink feed operation) is done by the same driving source as that of the printing press in synchronism with the rotation of the plate cylinder 8 (the rotation of the printing press), thereby obtaining a predetermined ink transfer amount. For example, the ink ductor roller 5 is reciprocally swung once by a driving cam that rotates once in synchronism with six revolutions of the plate cylinder 8.

Along with the recent increase in operation speed of printing presses, the balance between the ink supply amount to a printing paper sheet and the open/close of ink fountain keys becomes delicate. It is therefore difficult to stably supply ink. Especially, for a printing product with a low image area ratio (a printing product with a small image), ink in an excess amount is supplied into the ink supply apparatus, resulting in a density variation.

An ink feed apparatus disclosed in Japanese Patent Laid-Open No. 5-147200 (reference 1), the swing of the ink ductor roller is intermittently stopped to reduce the ink supply amount into the ink supply apparatus, thereby suppressing a density variation in a printing product with a small image. To intermittently stop the swing operation, for example, the number of revolutions of a rotary shaft that rotates coaxially with a driving cam that reciprocally swings the ink ductor roller is detected by a sensor. An air cylinder is actuated at a ratio corresponding to an integral ratio to the detected number of revolutions. With this operation, the ink ductor roller is forcibly pressed against (locked to) the ink roller side, thereby stopping the reciprocal operation of the ink ductor roller.

The ink feed apparatus described in patent reference 1, however, the operator checks the image of the printing product to be printed or the finished printing product and determines whether intermittent stop of the ink feed operation should be executed. Only experienced operators can make correct determination. If the ink feed operations are not thinned out when the number of times of ink feed must be decreased (when the ink feed operation must be intermittently stopped), or conversely, if the ink feed operations are thinned out when an operation in a normal state is necessary, normal printing products cannot be obtained. Alternatively, if a density variation occurs after the start of actual printing, the mode must then be switched to thinning-out operation to adjust the opening ratio of each ink fountain key. In this case, the amount of wasted paper increases, the operation takes long time, the load on the operator increases, the printing materials are wasted, and the operation efficiency becomes low.

SUMMARY OF THE INVENTION

It is an object of the present invention to provide an ink supply amount control method and apparatus for a printing press, which can reduce the load on the operator by automatically determining whether intermittent stop of the ink feed operation should be executed.

In order to achieve the above object, according to the present invention, there is provided an ink supply amount control method for a printing press, comprising the steps of counting the number of ink fountain keys whose gap amount with respect to an ink fountain roller falls within a predetermined range, controlling, on the basis of a count value of the ink fountain keys, a swing operation of an ink ductor roller which is arranged in an ink supply path and swings in synchronism with rotation of the printing press, supplying ink from a gap between the plurality of ink fountain keys and the ink fountain roller to the ink supply path in accordance with rotation of the ink fountain roller at the time of printing, and supplying the ink to a printing plate attached to a plate cylinder through the ink supply path by the swing operation of the ink ductor roller.

DESCRIPTION OF THE PREFERRED EMBODIMENTS

Figure 14:
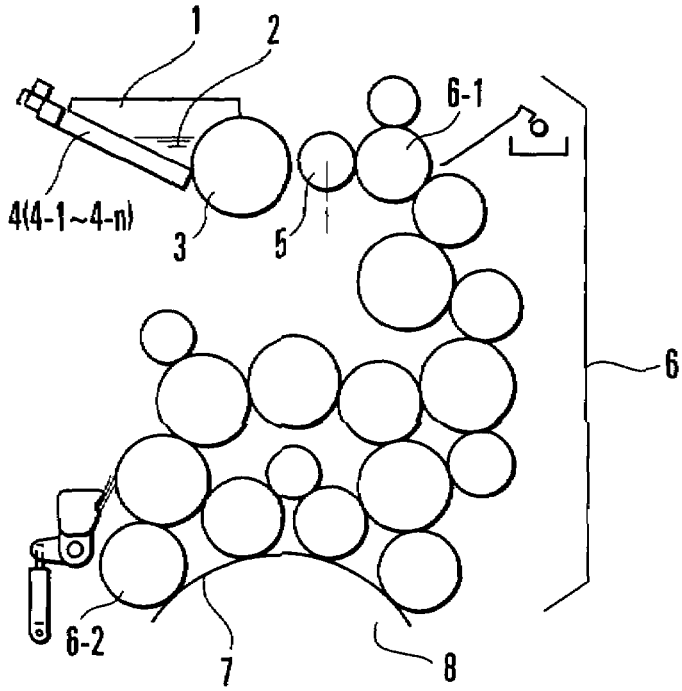
FIG. 14 is a view showing the main part of an ink supply apparatus provided in a printing unit for each color in a rotary printing press.
Figure 15:
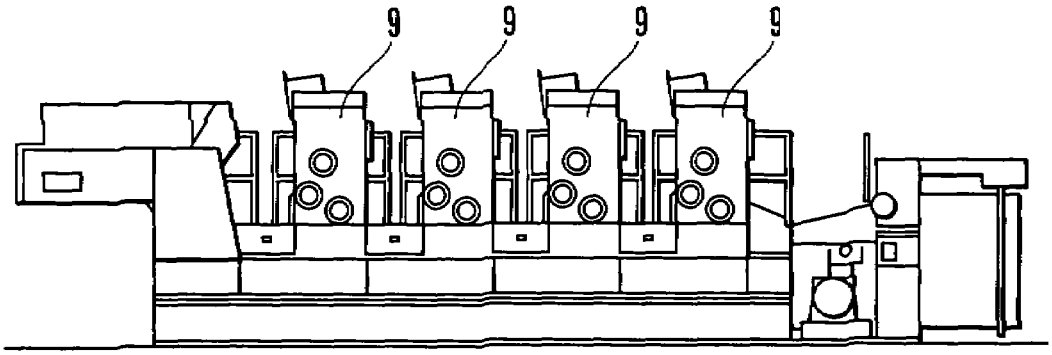
FIG. 15 is a side view showing the schematic arrangement of a four-color rotary printing press.

The present invention will be described below in detail with reference to the accompanying drawings. An ink supply apparatus and four-color rotary printing press have the same arrangements as in FIGS. 14 and 15, and a description thereof will be omitted.

First Embodiment

Manual Method

As the first embodiment, a method (manual method) of causing an operator to instruct at his/her own discretion to or not to perform "intermittent stop+correction" will be described.

Figure 1:
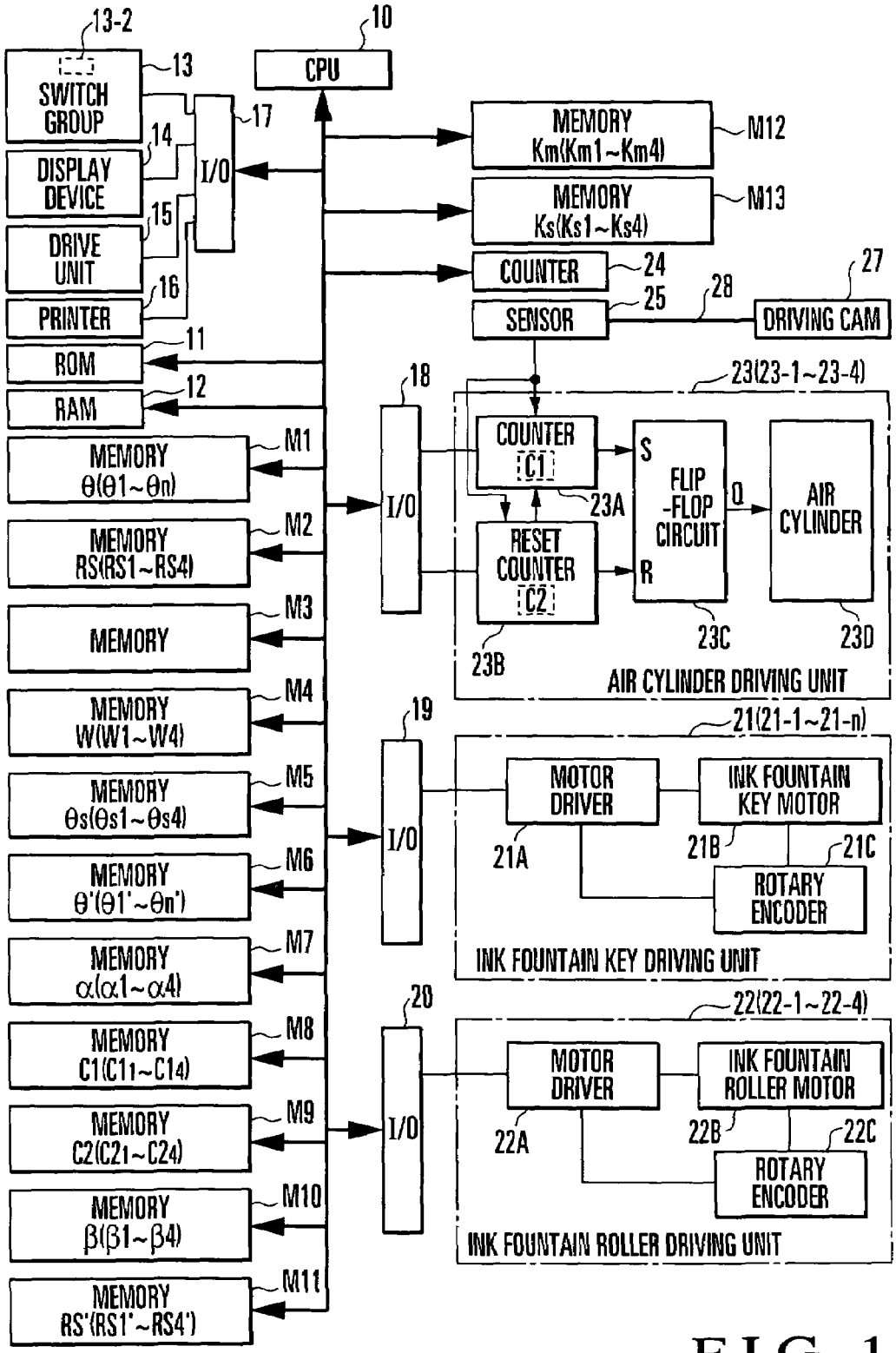
FIG. 1 is a block diagram of an ink supply amount control apparatus for a printing press according to the first embodiment of the present invention.

FIG. 1 shows an ink supply amount control apparatus for a printing press according to the first embodiment of the present invention. Referring to FIG. 1, reference numeral 10 denotes a CPU (Central Processing Unit); 11, a ROM (Read Only Memory); 12, a RAM (Random Access Memory); 13, a switch group including a correction button 13-1; 14, a display device; 15, a drive unit for a flexible disk or magnetic card; 16, a printer; and 17 to 20, input/output interfaces (I/O). Reference symbols M1 to M11 denote memories which stores various kinds of data. Reference numeral 21 denotes an ink fountain key driving unit; 22, an ink fountain roller driving unit; and 23, a feed stop air cylinder driving unit.

The CPU 10 obtains various kinds of input information that are supplied through the interface 17 and operates in accordance with a program stored in the ROM 11 while accessing the RAM 12. The ROM 11 stores a program (ink supply amount control program) which controls the ink supply amount to a printing plate 7 in a printing unit 9 of each color. This ink supply amount control program may be provided in the form of a recording medium such as a CD-ROM such that the program can be read out from the recording medium and installed in a hard disk (not shown).

The ink fountain key driving unit 21 is individually arranged in correspondence with each of ink fountain keys 4-1 to **4-*n* of each color. More specifically, one printing unit 9 has n ink fountain key driving units 21 (21-1 to 21-*n*) corresponding to n ink fountain keys 4 (4-1 to 4-*n*). These components are prepared in correspondence with each of the four printing units. The opening ratios of the ink fountain keys 4-1 to 4-*n* with respect to an ink fountain roller 3 are individually adjusted by the ink fountain key driving units 21-1 to 21-*n*. Each of the ink fountain key driving units 21-1 to 21-*n* comprises a motor driver 21A, an ink fountain key motor 21B which is driven by the motor driver 21A, and a rotary encoder 21C which detects the rotation state of the ink fountain key motor 21**B.

The ink fountain roller driving unit 22 is, individually arranged in correspondence with each of the fountain rollers 3 of the respective colors. More specifically, the four-color rotary printing press has four ink fountain roller driving units 22-1 to 22-4 in correspondence with the four printing units 9. The feed amounts of the ink fountain rollers 3 of the respective colors are individually adjusted by the ink fountain roller driving units 22-1 to 22-4. Each of the ink fountain roller driving units 22-1 to 22-4 comprises a motor driver 22A, an ink fountain roller motor 22B which is driven by the motor driver 22A, and a rotary encoder 22C which detects the rotation state of the ink fountain roller motor 22B.

The feed stop air cylinder driving unit 23 is individually arranged in correspondence with each of ink ductor rollers 5 of the respective colors. More specifically, the four-color rotary printing press has four air cylinder driving units 23-1 to 23-4 in correspondence with the four printing units. The feed operations of the ink ductor rollers 5 of the respective colors are intermittently stopped by the air cylinder driving units 23-1 to 23-4.

Each of the air cylinder driving units 23-1 to 23-4 comprises a feed stop start counter 23A, a feed counter reset counter 23B, a flip-flop circuit 23C, and a feed stop air cylinder 23D. The counter 23A and reset counter 23B receive a 1-pulse signal from an ink feed cam rotation detection sensor 25 in correspondence with every revolution of a rotary shaft 28 that rotates coaxially with a driving cam 27 for reciprocally swinging the ink ductor roller 5. The mechanism that causes the driving cam 27 to reciprocally swing the ink ductor roller 5 is known, as indicated by reference 1. The contents described in reference 1 are incorporated in this specification.

Image data θ (θ1 to θn) of the printing plate 7 attached to a plate cylinder 8 in the printing unit 9 is written in the memory M1 in correspondence with each color. The image data θ is read out from, e.g., a recording medium set in the drive unit 15. Feed amount data RS (RS1 to RS4) of the ink fountain roller 3 of the printing unit 9 of each color is written in the memory M2. The feed amount data RS is read out from, e.g., a recording medium set in the drive unit 15. The "image area ratio—ink fountain key opening ratio conversion curve" of each color is stored in the memory M3.

A number W (W1 to W4) of times of stop of the feed operation of the ink ductor roller 5 in the printing unit 9 of each color is written in the memory M4. The number W of times of stop is set by the operator's key operation on the switch group 13. The "number of times of stop of the feed operation" represents the ratio of stop of the feed operation. In this embodiment, it means the number of times of or the ratio for thinning out the feed operations. For example, when the number W of times of stop is 1, the feed operation is stopped one cycle and then performed one cycle (although two cycles are required in fact, the feed operation is stopped one cycle). When the number W of times of stop is 2, the feed operation is stopped two cycles and then performed one cycle (although three cycles are required in fact, the feed operation is stopped two cycles).

A predetermined value that is used to determine whether the opening ratio of each ink fountain key in the printing unit 9 of each color corresponds to a small image portion is written in the memory M5 as a small image portion determination value θs (θs1 to θs4). The small image portion determination value θs is set by the operator's key operation on the switch group 13. An opening ratio correction value θ' (θ1' to θn') obtained by correcting an opening ratio set value θ (θ1 to θn) of each ink fountain key 4 in the printing unit 9 by processing to be described later is written in the memory M6 in correspondence with each color.

A correction coefficient α (α1 to α4) of the opening ratio of each ink fountain key 4 in the printing unit 9 of each color is written in the memory M7. The correction coefficient α is set by the operator's key operation on the switch group 13 as an arbitrary value that satisfies α>0. A set value C1 ($C1_1$ to $C1_4$) to be set in the counter 23A of the air cylinder driving unit 23 corresponding to the printing unit 9 of each color, which is obtained from the number W of times of stop, is written in the memory M8. The number W of times of stop is set by the operator's key operation.

A set value C2 ($C2_1$ to $C2_4$) to be set in the reset counter 23B of the air cylinder driving unit 23 in the printing unit 9 of each color, which is obtained from the number W of times of stop set by the operator's key operation, is written in the memory M9.

A correction coefficient β (β1 to β4) of the feed amount, which is set for the ink fountain roller 3 in the printing unit 9 of each color, is written in the memory M10. The correction coefficient β is set by the operator's key operation on the switch group 13 as an arbitrary value that satisfies β>0. A feed amount correction value RS' (RS1' to RS4') obtained by correcting the feed amount set value RS (RS1 to RS4) of the ink fountain roller 3 in the printing unit 9 of each color by processing to be described later is written in the memory M11.

A small image portion counter 24 counts the number of small image portions of the printing plate 7 attached to the plate cylinder 8 of each color. Counting the number of small image portions will be described later. The number Km (Km1 to Km4) of small image portions counted by the small image portion counter 24 is written in a memory M12. The number of small image portions of each color, which is to be used to determine whether intermittent stop of the ink feed operation should be executed, is written in a memory M13 as a small image portion count determination value Ks (Ks1 to Ks4).

OPERATION EXAMPLE 1

Intermittent Stop+Ink Fountain Key Opening Ratio Correction

The operation (operation example 1) of the ink supply amount control apparatus having the above arrangement before the start of printing will be described with reference to FIGS. 2A and 2B. The same operation is executed in all the printing units 9, and the operation in one printing unit 9 will be described here.

Before the operation starts, the "image area ratio—ink fountain key opening ratio conversion curve" of each color is stored in the memory M3 in advance. In addition, the number W (w1 to W4) of times of stop of feed operation for the ink fountain roller 3 of the printing unit 9 of each color is written in the memory M4 in advance by the operator's key operation on the switch group 13. Similarly, the small image portion determination value θs (θs1 to θs4) is stored in the memory M5. The correction coefficient α (α1 to α4) of the opening ratio of each ink fountain key 4 is written in the memory M7. The small image portion count determination value Ks (Ks1 to Ks4) is written in the memory M13.

[Read and Storage of Image Data and Feed Amount Data]

The CPU 10 reads out the image data of the printing plate 7 attached to the plate cylinder 8 in the printing unit 9 and the feed amount data RS of the ink fountain roller 3 in the printing unit 9 from, e.g., a recording medium set in the drive unit 15. The readout image data is written in the memory M1 as an opening ratio set value of the ink fountain key 4. The feed amount data RS is written in the memory M2 as a feed amount set value of the ink fountain roller 3 (steps S101 and S102).

As the image data, image area ratio data S1 to Sn of each area of the printing plate 7 corresponding to the ink fountain roller driving units 22-1 to 22-4 in the printing unit 9 may be input. Alternatively, the ink fountain key opening ratio data θ1 to θn obtained by converting the image area ratio of each area of the printing plate 7 corresponding to the ink fountain key 4 into the opening ratio of the ink fountain key 4 may be input.

It is determined next whether the input image data is image area ratio data (step S103). If YES in step S103, the CPU 10 reads out the "image area ratio—ink fountain key opening ratio conversion curve" stored in the memory M3 (step S104). The CPU 10 converts the image area ratio data S1 to Sn into the ink fountain key opening ratios θ1 to θn by using the readout "image area ratio—ink fountain key opening ratio conversion curve" and stores the ink fountain key opening ratios θ1 to θn in the memory M1 again (step S105).

If NO in step S103, the CPU 10 immediately advances to step S106. Accordingly, the opening ratios θ1 to θn of the ink fountain keys 4 are written in the memory M1 as set values.

[Determination of Necessity of Intermittent Stop of Ink Feed Operation]

It is subsequently determined in the following manner whether intermittent stop of the ink feed operation should be executed. It is determined whether the operator has pressed the automatic setting switch 13-2 of the switch group 13 (step S106). When the automatic setting switch 13-2 is turned on, the CPU 10 resets the count value of the small image portion counter 24 to zero (step S107).

The CPU 10 reads out the first ink fountain key opening ratio set value θ1 from the memory M1 and the small image portion determination value θs from the memory M5 (steps S108 and S109). The CPU 10 compares the ink fountain key opening ratio set value θ1 with the small image portion determination value θs (step S110). If θ1<θs, the count value of the small image portion counter 24 is incremented by one (step S111). If θ1≧θs, the flow immediately advances to step S112.

More specifically, if θ1<θs, the area of the printing plate 7, which corresponds to an ink fountain key 4-1, is determined as a small image portion. The count value of the small image portion counter 24 is incremented by one. If θ1≧θs, the area of the printing plate 7, which corresponds to the ink fountain key 4-1, is determined as a large/medium image portion. The flow immediately advances to step S112 without incrementing the count value of the small image portion counter 24.

The CPU 10 reads out the next ink fountain key opening ratio set value θ2 from the memory M1 and the small image portion determination value θs from the memory M5 (steps S112 and S113). The CPU 10 compares the ink fountain key opening ratio set value θ2 with the small image portion determination value θs (step S114). If θ2<θs, the area is determined as a small image portion, as in step S111, and the count value of the small image portion counter 24 is incremented by one (step S115). If θ2≧θs, the area is determined as a large/medium image portion, and the flow immediately advances to step S116.

In the same way, the CPU 10 repeats the operation in steps S112 to S115 until the read of all ink fountain key opening ratio set values θ from the memory M1 is confirmed (step S116). With this operation, the counter 24 counts the number of ink fountain keys (the number of small image portions), of all the ink fountain keys 4, which are determined as small image portions because the opening ratio set values θ are smaller than θs.

The CPU 10 writes a number Km of small image portions counted by the counter 24 in the memory M12 (step S117), reads out the small image portion count determination value Ks from the memory M13 (step S118), and compares the number Km of small image portions with the small image portion count determination value Ks (step S119).

If Km≦Ks, the CPU 10 determines that the printing plate 7 set on the plate cylinder 8 in the printing unit 9 has a small number of small image portions, and intermittent stop of the ink feed operation is unnecessary.

In this case, the CPU 10 reads out the ink fountain key opening ratio set values θ1 to θn from the memory M1 (step S120), sends the readout ink fountain key opening ratio set values θ1 to θn to a motor driver 21A of an ink fountain key driving unit 21 (step S121), and adjusts the opening ratios of the ink fountain keys 4 to the set values θ1 to θn.

Next, the CPU 10 reads out the ink fountain roller feed amount set value RS from the memory M2 (step S122), sends the readout ink fountain roller feed amount set value RS to a motor driver 22A of an ink fountain roller driving unit 22 (step S123), and adjusts the feed amount of the ink fountain roller 3 at the time of printing to the set value RS.

In the above way, when the CPU 10 determines that the number of small image portions is small, the opening ratios of the ink fountain keys 4 are adjusted to the normal set values θ1 to θn. In addition, the feed amount of the ink fountain roller 3 at the time of printing is adjusted to the normal set value RS. The series of processing operations are thus ended.

To the contrary, if Km>Ks, the CPU 10 determines that the printing plate 7 set on the plate cylinder 8 in the printing unit 9 has a large number of small image portions, and intermittent stop of the ink feed operation is necessary.

In this case, the CPU 10 reads out the number W of times of stop from the memory M4 (step S124). A set value C1 for a counter 23A in an air cylinder driving unit 23 and a set value C2 for a reset counter 23B are obtained from the number W of times of stop and written in memories M8 and M9 (step S125). The set value C1 is set in the counter 23A, and the set value C2 is set in the reset counter 23B (steps S126 and S127).

For example, when the number W of times of stop is 1, it is determined that although two cycles of feed operation are required in fact, the feed operation should be stopped one cycle. The set value C1 for the counter 23A is set to 1, and the set value C2 for the reset counter 23B is set to 2. When the set values C1 and C2 are set for the counter 23A and reset counter 23B, preparation for intermittent stop of the ink feed operation of the ink ductor roller 5 in the printing unit 9 is done. Actual printing may be executed at this time.

[Intermittent Stop of Ink Feed Operation]

Intermittent stop of the ink feed operation in the printing unit 9 will be described by exemplifying a case wherein the number W of times of stop is 1. When the operation of the printing press starts, a 1-pulse signal (sensor signal) is generated by the sensor 25 in correspondence with every revolution of the rotary shaft 28 that rotates coaxially with the driving cam 27 that reciprocally swings the ink ductor roller 5 in synchronism with the rotation of the printing press. The sensor signal from the sensor 25 is supplied to the counter 23A and reset counter 23B.

Upon counting the sensor signal C1 times (once in this example), the counter 23A outputs "H" level to the S input of the flip-flop circuit 23C to set the flip-flop circuit 23C and set the Q output to "H" level. In accordance with the Q output of "H" level from the flip-flop circuit 23C, the air cylinder 23D is actuated to press the ink ductor roller 5 to the side of an ink roller 6-1 so that the ink feed operation is stopped during this time. Even while the ink feed operation is stopped, the rotary shaft that rotates coaxially with the driving cam that reciprocally swings the ink ductor roller 5 continuously rotates. Hence, the input of the sensor signal to the counter 23A and reset counter 23B continues.

Upon counting the sensor signal C2 times (twice in this example), the reset counter 23B resets the flip-flop circuit 23C to set the Q output to "L" level. Accordingly, the air cylinder 23D is restored to the inactive state, and the ink feed operation is resumed. Upon counting the sensor signal C2 times, the reset counter 23B returns the count value of its own and the count value of the counter 23A to zero to prepare for the next sensor signal input. As described above, when the number W of times of stop is 1, the ink feed operation is stopped one cycle and then executed one cycle. In this way, the ink feed operation is intermittently stopped.

[Correction of Ink Fountain Key Opening Ratio]

The CPU 10 reads out the first ink fountain key opening ratio set value θ1 from the memory M1 and the small image portion determination value θs from the memory M5 (steps S128 and S129). The CPU 10 compares the readout ink fountain key opening ratio set value θ1 with the small image portion determination value θs (step S130). If θ1<θs, the flow advances to step S131. If θ1≧θs, the flow advances to step S132.

If θ1<θs, the area of the printing plate 7, which corresponds to the ink fountain key 4, is determined as a small image portion. The ink fountain key opening ratio set value θ1 read out from the memory M1 is directly written in the memory M6 as θ1' (step S131).

If θ1≧θs, the area of the printing plate 7, which corresponds to the ink fountain key 4, is determined as a large/medium image portion. The correction coefficient α is read out from the memory M7 (step S132). The CPU 10 multiplies the ink fountain key opening ratio set value θ1 read out from the memory M1 by the readout correction coefficient α to obtain a correction amount for the set value θ1 (step S133).

The CPU 10 adds the obtained correction amount to the set value θ1 to obtain an ink fountain key opening ratio correction value θ1' and writes it in the memory M6 (step S134). If the corresponding area is a large/medium image portion, the opening ratio set value θ1 of the ink fountain key 4 is corrected such that it increases by the product of the set value and the correction coefficient α.

The CPU 10 reads out the next ink fountain key opening ratio set value θ2 from the memory M1 and the small image portion determination value θs from the memory M5 (steps S135 and S136). The CPU 10 compares the ink fountain key opening ratio set value θ2 with the small image portion determination value θs (step S137). If θ2<θs, the set value θ2 is directly written in the memory M6 as θ2', as in step S131 (step S138).

If θ2≧θs, as in steps S132 to S134, the correction coefficient α is read out from the memory M7 (step S139). The set value θ2 is multiplied by the correction coefficient α to obtain a correction amount (step S140). A value obtained by adding the resultant correction amount to the set value θ2 is written in the memory M6 as θ2' (step S141).

In the same way, the CPU 10 repeats the operation in steps S135 to S141 until the read of all ink fountain key opening ratio set values θ from the memory M1 is confirmed (step S142). With this operation, the opening ratio correction values θ1' to θn' of all ink fountain keys are stored in the memory M6.

The ink fountain key opening ratio correction values θ1' to θn' stored in the memory M6 are not actually corrected when the set value θ is smaller than the small image portion determination value θs. The opening ratio correction values θ1' to θn' are corrected when the set value θ is larger than the small image portion determination value θs. That is, the ink fountain key opening ratio set values θ1 to θn corresponding to the ink fountain keys 4 are not corrected when the corresponding area is a small image portion (θ<θs). Only for a large/medium image portion (θ≧θs), the set values θ1 to θn are corrected to larger values.

As described above, in operation example 1, it is determined on the basis of the ink fountain key opening ratio set value θ whether an area corresponding to each ink fountain key is a small image portion. Only for an area that does not correspond to a small image portion, the ink fountain key opening ratio set value θ is corrected.

When the ink fountain key opening ratio correction values θ1' to θn' are stored in the memory M6 in step S142, the CPU 10 reads out the ink fountain key opening ratio correction values θ1' to θn' from the memory M6 (step S143) and sends the readout ink fountain key opening ratio correction values θ1' to θn' to the motor driver 21A of the ink fountain key driving unit 21 (step S144). The ink fountain key motor 21B is driven to adjust the opening ratios of the ink fountain keys 4 in the printing unit 9 to the correction values θ1' to θn'.

Next, the CPU 10 reads out the ink fountain roller feed amount set value RS from the memory M2 (step S145) and sends the readout set value RS to the motor driver 22A of the ink fountain roller driving unit 22 (step S146). Accordingly, at the time of printing, the feed amount of the ink fountain roller 3 in the printing unit 9 is adjusted to the set value RS.

In operation example 1, whether the ink feed operation should intermittently be stopped is automatically determined on the basis of the number of small image portions. Hence, the problems posed by inexperienced operators, in which the ink feed operations are not thinned out when the number of times of ink feed must be decreased, or the ink feed operations are thinned out when an operation in a normal state is necessary, can be prevented, and normal printing products can be obtained. In addition, the problems that the amount of wasted paper increases, the operation takes long time, the load on the operator increases, the printing materials are wasted, and the operation efficiency becomes low can also be solved.

In operation example 1, when the ink feed operation is to be intermittently stopped, of the ink fountain key opening ratio set values θ1 to θn for the ink fountain keys 4-1 to 4-4, only the set values corresponding to large/medium image portions except small image portions are corrected to larger values. Accordingly, the ink supply amount to a large/medium image portion increases. The excess ink supply to a small image portion and a shortage of the ink supply amount to a large/medium image portion are simultaneously solved. Hence, the operator need not adjust the opening ratio of each ink fountain key or the feed amount of the ink roller while repeating test printing.

OPERATION EXAMPLE 2

Intermittent Stop+Ink Fountain Roller Feed Amount Correction

In operation example 1 described above, when the ink feed operation should intermittently be stopped, the ink fountain key opening ratio set values θ1 to θn are corrected in accordance with the image area ratio. In place of the ink fountain key opening ratio set values θ1 to θn, the set value RS of the feed amount of the ink fountain roller 3 may be corrected in accordance with the image area ratio.

In operation example 2 to be described below, the set value RS of the feed amount of the ink fountain roller 3 is corrected in correspondence with a large/medium image portion. With this operation, the ink supply amount to the large/medium image portion that requires a higher ink fountain key opening ratio is increased as compared to a small image portion that requires a low ink fountain key opening ratio.

Figure 3:
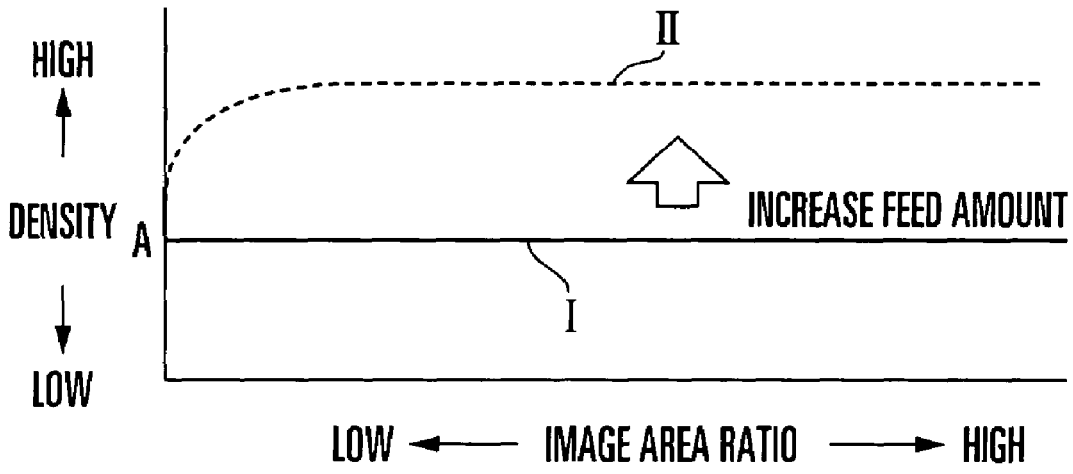
FIG. 3 is a graph showing the relationship between the image area ratio and the printing density when the ink fountain roller feed amount is adjusted.

When the ink fountain roller feed amount is adjusted, the image area ratio (abscissa) vs. printing density (ordinate) characteristic changes as shown in FIG. 3. A characteristic I indicates a state wherein the printing density has a predetermined value A independently of the image area ratio. When the ink fountain roller feed amount is increased, the density value increases. In this case, as indicated by a characteristic II, the increase in printing density value with respect to the increase in ink fountain roller feed amount is small at a portion having a low image area ratio. As the image area ratio becomes high, the printing density value gradually increases. When the image area ratio reaches a certain value, the printing density value becomes almost constant. As is apparent from this fact, when the ink fountain roller feed amount is increased, the ink supply amount to a large/medium image portion more largely increases as compared to the increase in ink supply amount to a small image portion.

The operation procedures in operation example 2 will be described next with reference to FIG. 4. The flow chart shown in FIG. 4 explains operation procedures following step S119 in FIG. 2A. The operation until step S119 is the same as in operation example 1, and a description thereof will be omitted. Before the operation starts, the feed amount correction coefficient β (β1 to β4) for the ink fountain roller 3 in the printing unit 9 of each color is written in the memory M10 by the operator's key operation on the switch group 13.

If it is confirmed that Km>Ks (NO in step S119 in FIG. 2), the CPU 10 determines that the printing plate 7 set on the plate cylinder 8 in the printing unit 9-1 has a large number of small image portions, and intermittent stop of the ink feed operation is necessary.

In this case, the CPU 10 reads out the number W of times of stop from the memory M4 (step S147). A set value C1 for a counter 23A in an air cylinder driving unit 23 and a set value C2 for a reset counter 23B are obtained from the number W of times of stop and written in memories M8 and M9 (step S148). The set value C1 is set in the counter 23A, and the set value C2 is set in the reset counter 23B (steps S149 and S150).

When the printing product has a small image, the CPU 10 reads out the ink fountain roller feed amount set value RS from the memory M2 (step S151). The CPU 10 reads out the correction coefficient β from the memory M10 (step S152). The ink fountain roller feed amount set value RS read out from the memory M2 is multiplied by the readout correction coefficient β to obtain the correction amount for the set value RS (step S153).

Next, the CPU 10 adds the obtained correction amount to the ink fountain roller feed amount set value RS read out from the memory M2 to obtain the ink fountain roller feed amount correction value RS' ($RS'=(1+\beta)\cdot RS$) and writes it in the memory M11 (step S154). Accordingly, the feed amount set value RS for the ink fountain roller 3 is corrected to be larger by the product of the set value RS and the correction coefficient β.

The CPU 10 reads out the ink fountain key opening ratio set values θ1 to θn from the memory M1 (step S155) and sends the readout ink fountain key opening ratio set values θ1 to θn to the motor driver 21A of the ink fountain key driving unit 21 (step S156). Accordingly, the ink fountain key motor 21B is driven to adjust the opening ratios of the ink fountain keys 4 in the printing unit 9 to the set values θ1 to θn.

The CPU 10 reads out the ink fountain roller feed amount correction value RS' from the memory M11 (step S157) and sends the readout ink fountain roller feed amount correction value RS' to the ink fountain roller motor driver 22A of the ink fountain roller driving unit 22 (step S158). Accordingly, at the time of printing, the feed amount of the ink fountain roller 3 in the printing unit 9 is adjusted to the correction value RS'.

In operation example 2, when the operator instructs intermittent stop of the ink feed operation and ink fountain roller feed amount correction at his/her own discretion, the set values C1 and C2 are automatically set in the air cylinder driving unit 23 to prepare for intermittent stop of the ink feed operation. At this time, correction is done such that the feed amount set value RS for the ink fountain roller 3 becomes large.

Hence, the ink supply amount to a large/medium image portion more largely increases as compared to the increase in ink supply amount to a small image portion. The excess ink supply to a small image portion and a shortage of the ink supply amount to a large/medium image portion are simultaneously solved. The operator need not adjust the opening ratio of each ink fountain key or the feed amount of the ink roller while repeating test printing.

OPERATION EXAMPLE 2

Automatic Method ②

Figure 5:
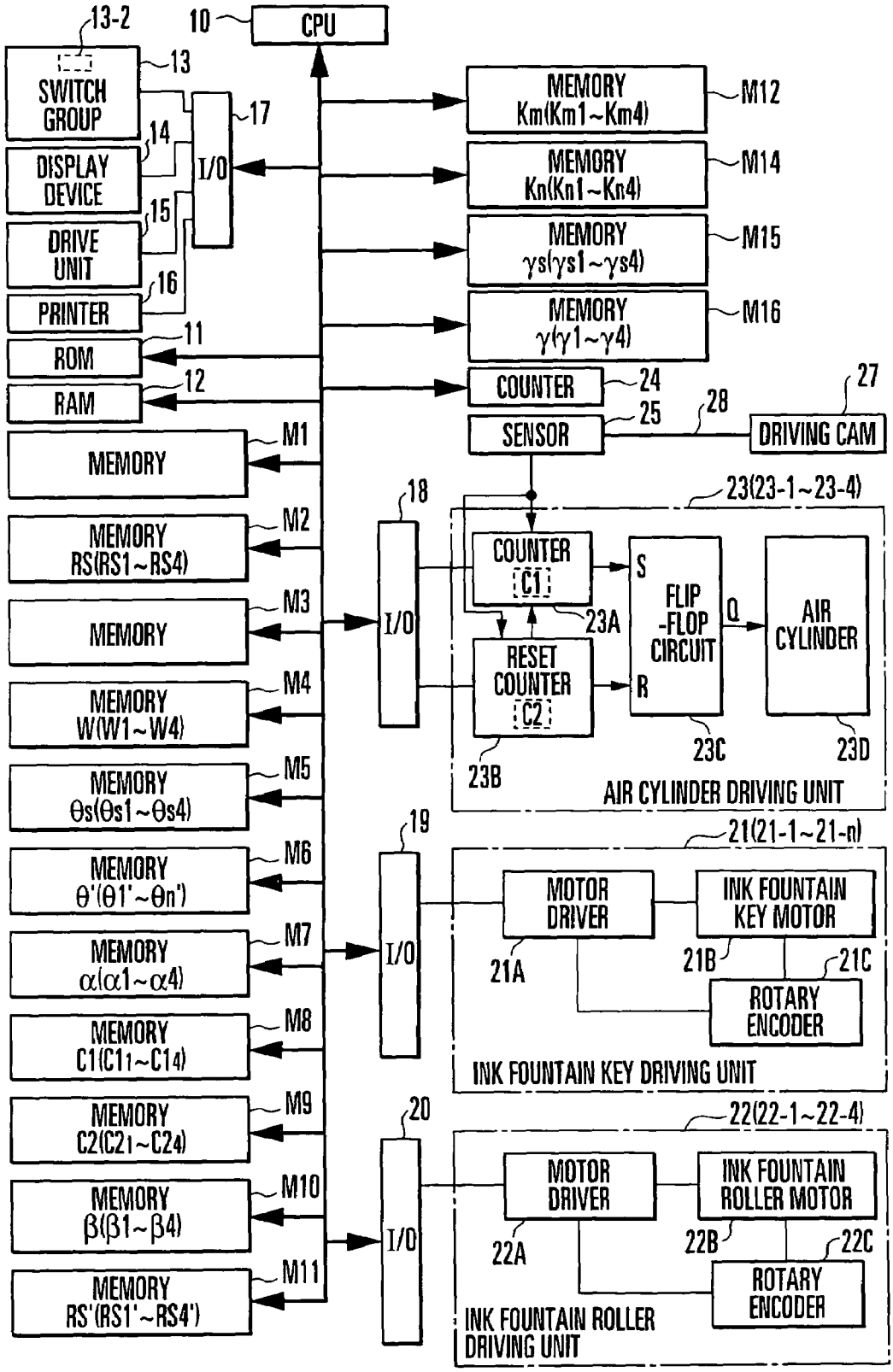
FIG. 5 is a block diagram of an ink supply amount control apparatus for a printing press according to the second embodiment of the present invention.

As the second embodiment, a second method (automatic method ② ) of automatically performing "intermittent stop+correction" in accordance with the determination of the CPU 10 will be described with reference to FIG. 5. The same reference numerals as in FIG. 1 denote the same or similar constituent elements in FIG. 5, and a description thereof will be omitted.

In operation example 2 to be described below, in place of the small image portion determination value memory M13 of the first embodiment, a memory M14 which stores the total number of ink fountain keys in each printing unit, a memory M15 which stores a determination value for the ratio of small image portions to the total number of ink fountain keys in each printing unit, and a memory M16 which stores the ratio of small image portions to the total number of ink fountain keys in each printing unit are arranged.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 6A and 6B. The same operation is executed in all printing units 9, and the operation in one printing unit will be described here.

In this embodiment, a total number Kn (Kn1 to Kn4) of ink fountain keys in the printing unit 9 of each color is written in the memory M14 in advance. A ratio (small image portion ratio determination value) γs (γs1 to γs4) of small image portions of each color, which is to be used to determine whether intermittent stop of the ink feed operation should be executed, is written in the memory M15 in advance.

Figure 2A:
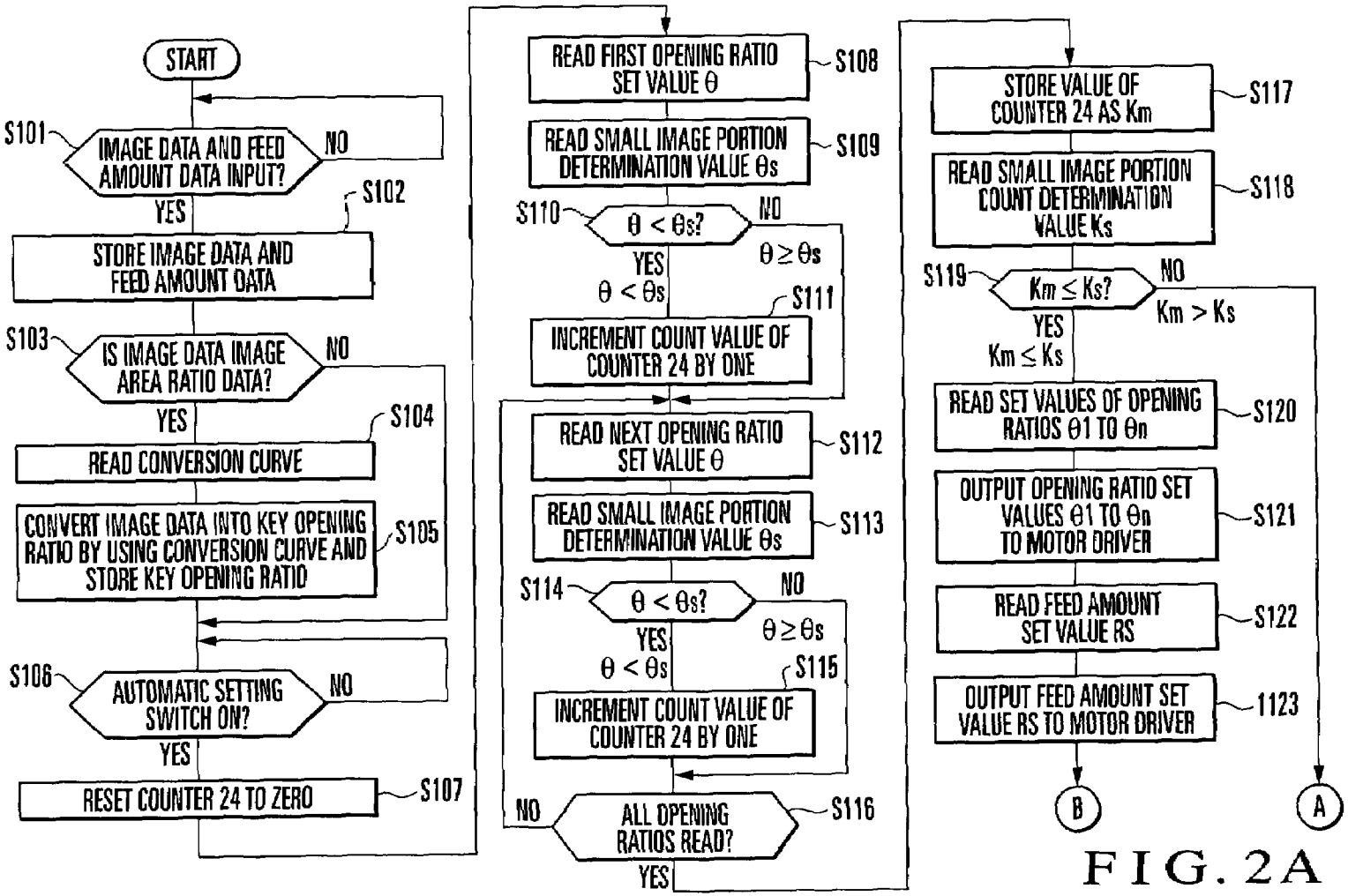
FIGS. 2A and 2B are flow charts for explaining the operation (operation example 1) of the ink supply amount control apparatus shown in FIG. 1 before the start of printing.
Figure 6A:
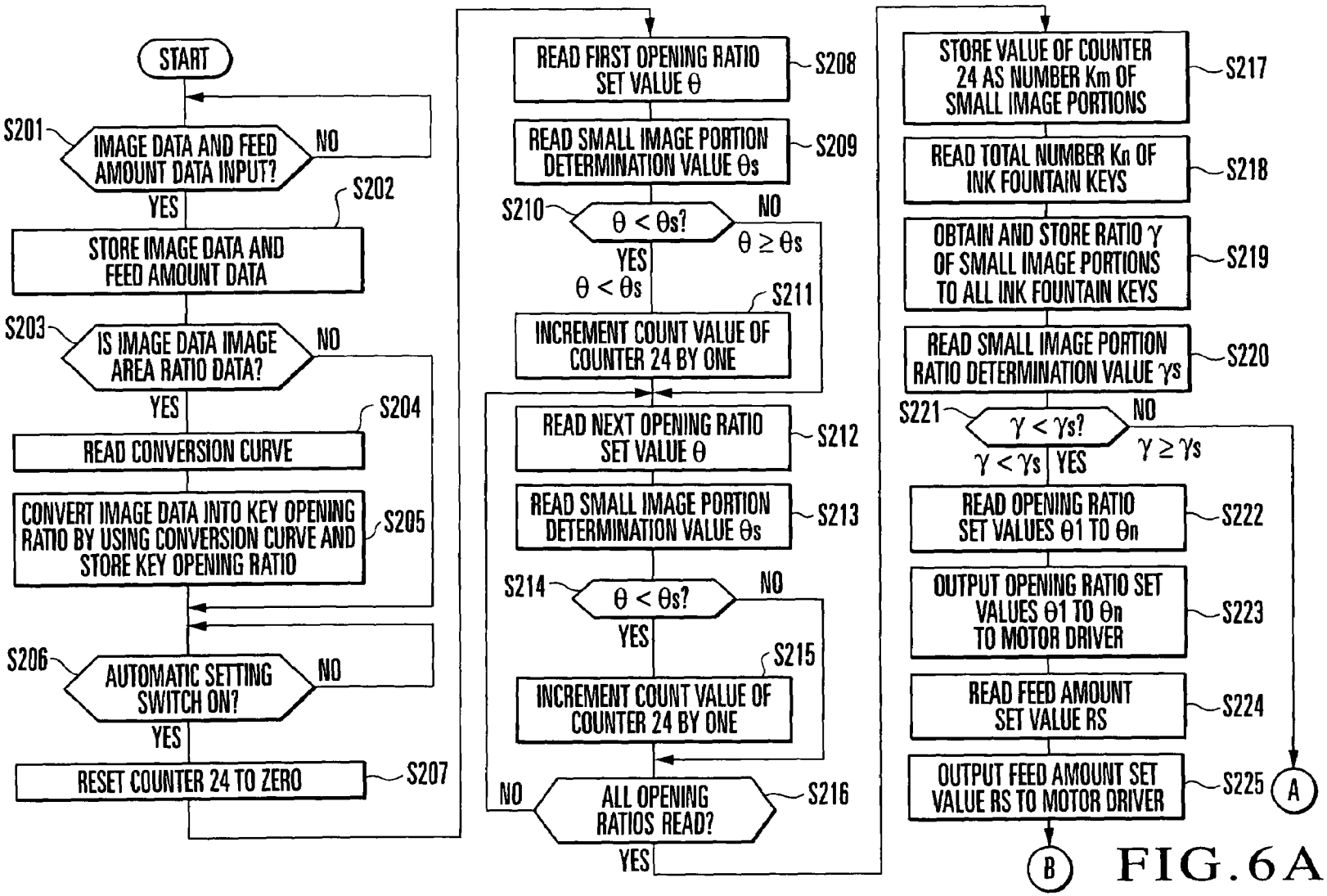
FIGS. 6A and 6B are flow charts for explaining the operation (operation example 1) of the ink supply amount control apparatus shown in FIG. 5 before the start of printing.
Figure 6B:
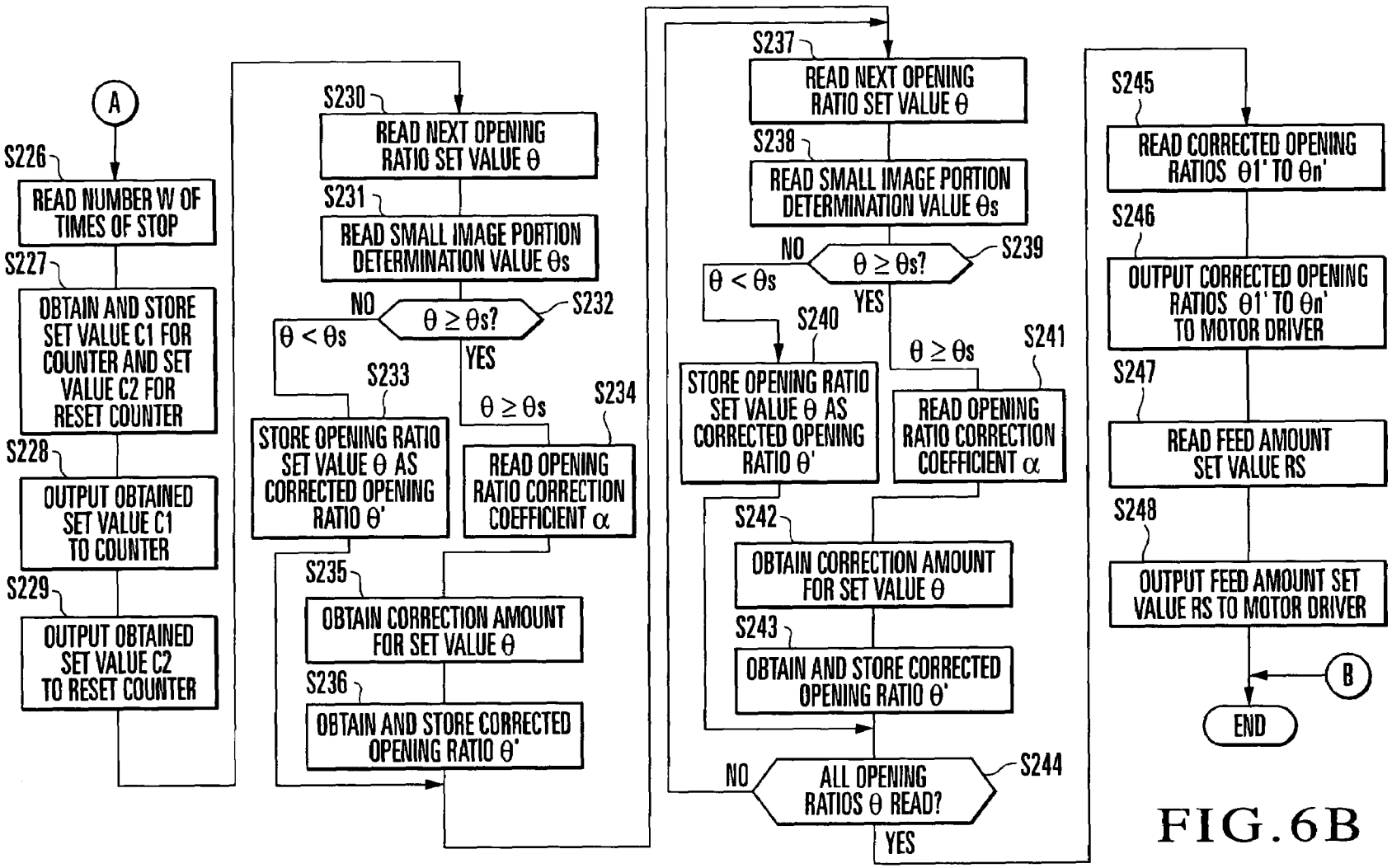

The operation in steps S201 to S217 in FIG. 6A is the same as that in steps S101 to S117 in FIG. 2A, and a description thereof will be omitted. When a number Km of small image portions is written in a memory M12 (step S217), the CPU 10 reads out the total number Kn of ink fountain keys in the printing unit 9, which is stored in the memory M14 (step S218).

The CPU 10 obtains a ratio γ (γ=Km/Kn) of small image portions to the total number of ink fountain keys in the printing unit 9 from the number Km of small image portions read out from the memory M12 and the total number Kn of ink fountain keys read out from the memory M14. The obtained ratio γ of small image portions to the total number of ink fountain keys is written in the memory M16 (step S219).

The CPU 10 reads out the small image portion ratio determination value γs of the printing unit 9 from the memory M15 (step S220) and compares the readout small image portion ratio determination value γs with the ratio γ of small image portions to the total number of ink fountain keys, which is obtained in step S219 (step S221).

If γ<γs, the CPU 10 determines that a printing plate 7 set on a plate cylinder 8 in the printing unit 9 has a small number of small image portions, and intermittent stop of the ink feed operation is unnecessary. In this case, by the processing operations in steps S222 to S225 corresponding to steps S120 to S123 in FIG. 2A, the opening ratios of the ink fountain keys 4 are adjusted to normal set values θ1 to θn. In addition, the feed amount of an ink fountain roller 3 at the time of printing is adjusted to a normal set value RS. The series of processing operations are thus ended.

To the contrary, if γ≧γs, the CPU 10 determines that the printing plate 7 set on the plate cylinder 8 in the printing unit 9 has a large number of small image portions, and intermittent stop of the ink feed operation is necessary. In this case, the CPU 10 adjusts the opening ratios of the ink fountain keys 4 to correction values θ1' to θn' by the processing operations in steps S226 to S248 corresponding to steps S124 to S146 in FIG. 6B.

In operation example 1, whether intermittent stop of the ink feed operation is to be executed is determined on the basis of the ratio of small image portions. The CPU 10 instructs intermittent stop of the ink feed operation on the basis of this determination. In accordance with this instruction, of the ink fountain key opening ratio set values θ1 to θn for the ink fountain keys 4, only the set values corresponding to large/medium image portions except small image portions are corrected to larger values. Since the ink supply amount to a large/medium image portion increases, the excess ink supply to a small image portion and a shortage of the ink supply amount to a large/medium image portion are simultaneously solved.

In operation example 1, whether the ink feed operation should intermittently be stopped is automatically determined on the basis of the ratio of small image portions. The operator never forgets to thin out the ink feed operations or erroneously thins out the ink feed operations. Hence, the problems posed by inexperienced operators can be prevented, and normal printing products can be obtained. In addition, the problems that the amount of wasted paper increases, the operation takes long time, the load on the operator increases, the printing materials are wasted, and the operation efficiency becomes low can also be solved.

In operation example 1, when the ink feed operation is to be intermittently stopped, of the ink fountain key opening ratio set values θ1 to θn for the ink fountain keys 4-1 to 4-4, only the set values corresponding to large/medium image portions except small image portions are corrected to larger values. Accordingly, the ink supply amount to a large/medium image portion increases. The excess ink supply to a small image portion and a shortage of the ink supply amount to a large/medium image portion are simultaneously solved. Hence, the operator need not adjust the opening ratio of each ink fountain key or the feed amount of the ink roller while repeating test printing.

OPERATION EXAMPLE 2

Intermittent Stop+Ink Fountain Roller Feed Amount Correction

In operation example 1 described above, when the ink feed operation should intermittently be stopped, the ink fountain key opening ratio set values θ1 to θn are corrected in accordance with the image area ratio. In place of the ink fountain key opening ratio set values θ1 to θn, the set value RS of the feed amount of the ink fountain roller 3 may be corrected in accordance with the image area ratio.

Figure 4:
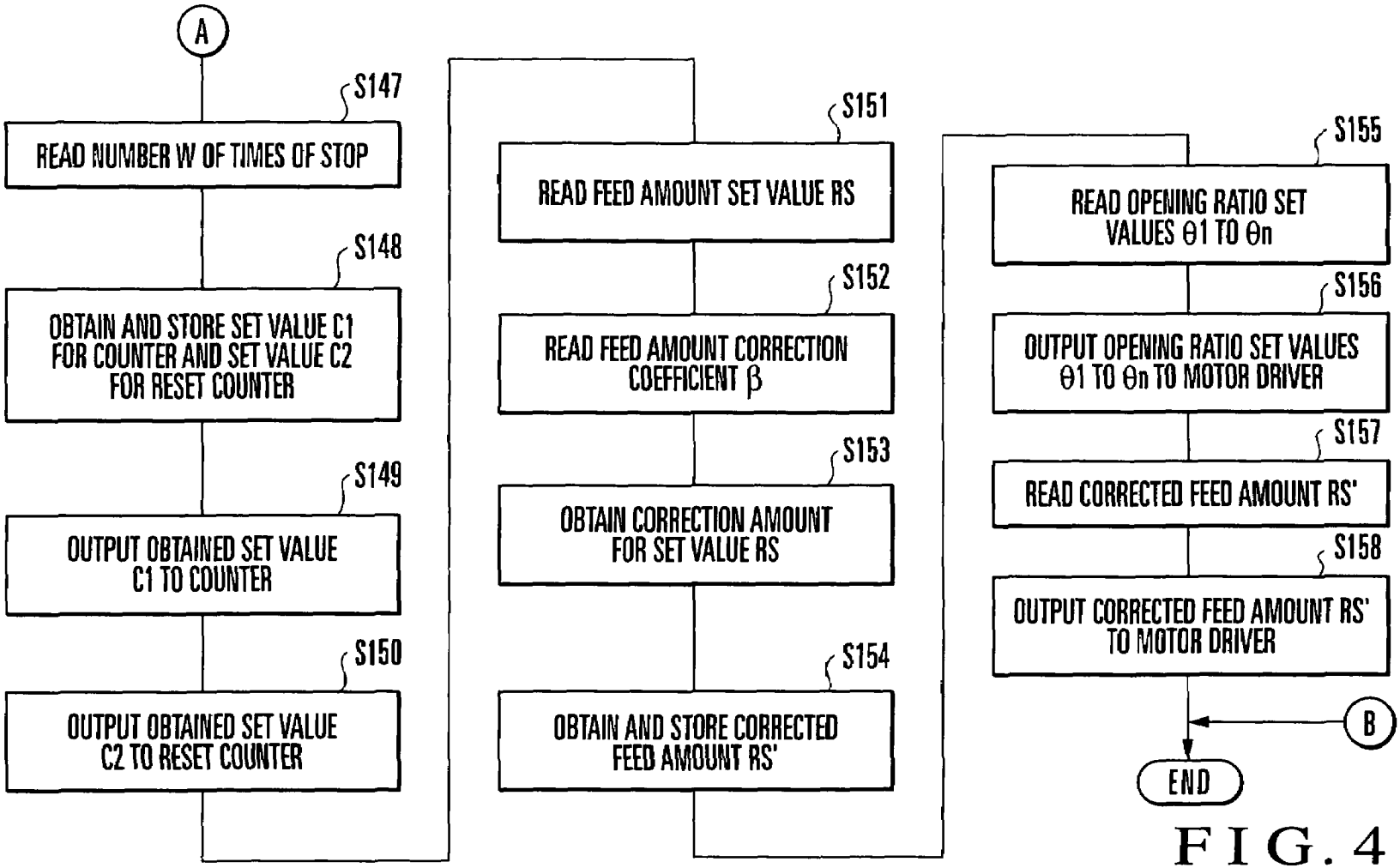
FIG. 4 is a flow chart for explaining the operation (operation example 2) of the ink supply amount control apparatus shown in FIG. 1 before the start of printing.
Figure 7:
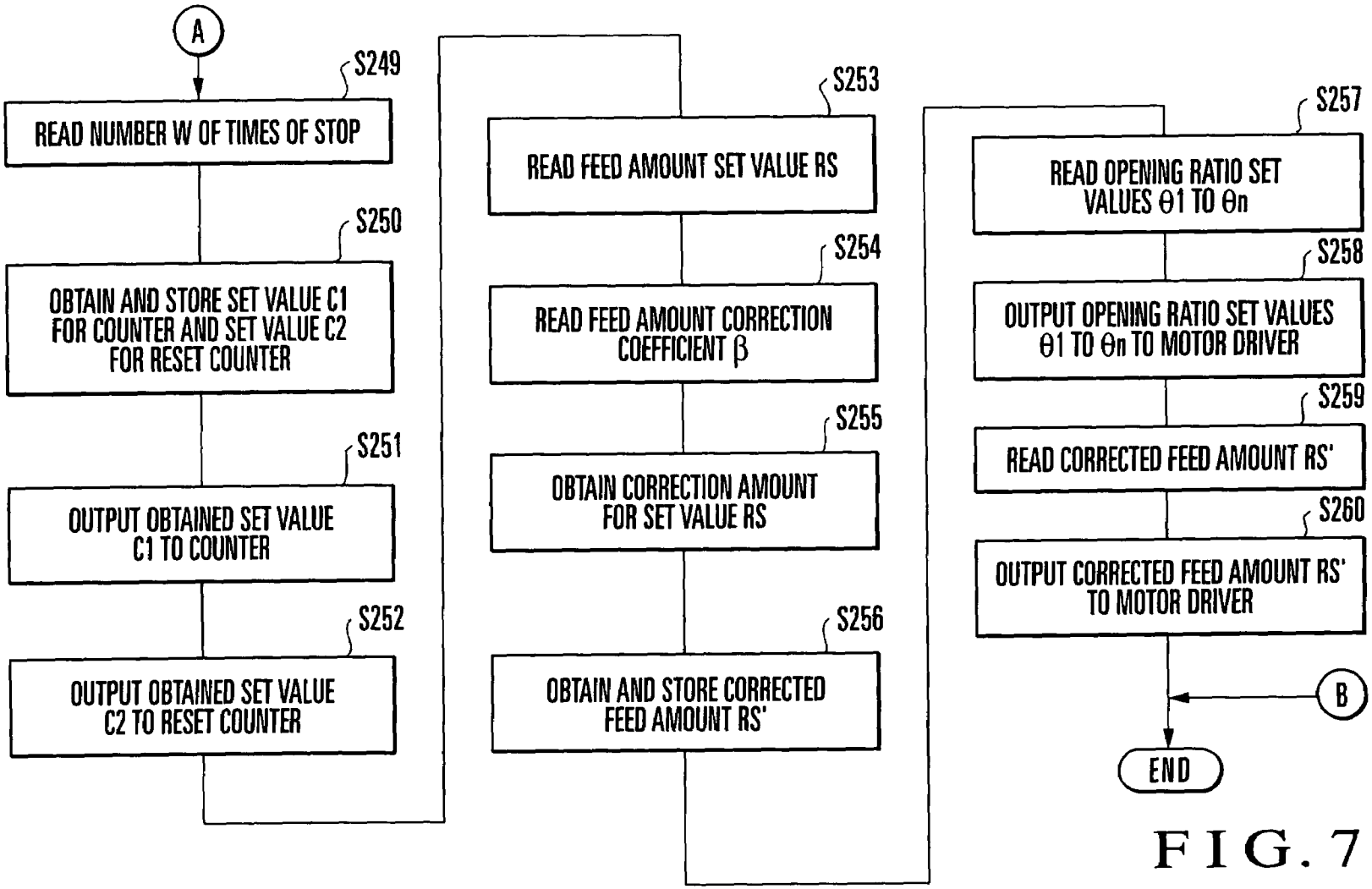
FIG. 7 is a flow chart for explaining the operation (operation example 2) of the ink supply amount control apparatus shown in FIG. 5 before the start of printing.

That is, if it is determined in step S221 (FIG. 6A) that γ≧γs, the feed amount of the ink fountain roller 3 may be adjusted to a correction value RS' by executing processing operations in steps S249 to S260 in FIG. 7 (processing operations corresponding to steps S147 to S158 in FIG. 4).

In operation example 2, whether intermittent stop of the ink feed operation is to be executed is automatically determined on the basis of the ratio of small image portions. The CPU 10 instructs intermittent stop of the ink feed operation on the basis of this determination. In accordance with this instruction, the feed amount set value RS for the ink fountain roller 3 is corrected to a larger value. Since the ink supply amount to a large/medium image portion increases more than that to a small image portion, the excess ink supply to a small image portion and a shortage of the ink supply amount to a large/medium image portion are simultaneously solved. As a result, the operator need not adjust the opening ratio of each ink fountain key or the feed amount of the ink roller while repeating test printing.

In operation example 2 described above, a small image portion determination value θs is defined, and the number of ink fountain keys having values smaller than the small image portion determination value θs is counted as the number Km of small image portions. That is, the number of ink fountain keys whose ink fountain key opening ratio set values θ1 to θn satisfy θ<θs is counted as the number Km of small image portions. However, the number of ink fountain keys which satisfy 0<θ<θs may be counted as the number Km of small image portions. When zero is excluded from the ink fountain key opening ratio set values θ1 to θn, an ink fountain key whose opening ratios at two ends are 0% and an ink fountain key of an unprinted portion are excluded. Only small image portions to be actually printed are counted as the number of small image portions.

Third Embodiment

In the above-described second embodiment, the ratio γ of the number Km of small image portions to the total number Kn of ink fountain keys in the printing unit 9 is obtained. The ratio γ may be obtained as a ratio of the number Km of small image portions not to the total number Kn of ink fountain keys but to a number Kx of ink fountain keys to be used for printing. The number Kx of ink fountain keys to be used for printing is obtained by, e.g., a method ① or ② to be described below. In these methods ① and ②, the number Km of small image portions equals the number of ink fountain keys for which the opening ratio set value is larger than zero and smaller than the small image portion determination value θs (0<θ<θs).

[① Method that Uses Paper Size Input as Preset Information]

When a total number n of ink fountain keys is an even number, paper size/ink fountain key width/2=a is calculated. The number Kx of ink fountain keys to be used for printing is obtained as Kx=(integral value obtained by carrying the fraction of a)×2. When the total number n of ink fountain keys is an odd number, [(paper size/ink fountain key width)−1]/2=a' is calculated. The number Kx of ink fountain keys to be used for printing is obtained as Kx=(integral value obtained by carrying the fraction of a')×2+1.

[② Method that Uses Image Data]

The number Kx of ink fountain keys to be used for printing is obtained as Kx=(total number n of ink fountain keys)−(number of ink fountain keys whose set value is 0%).

Detailed Examples of Third Embodiment

Figure 8:
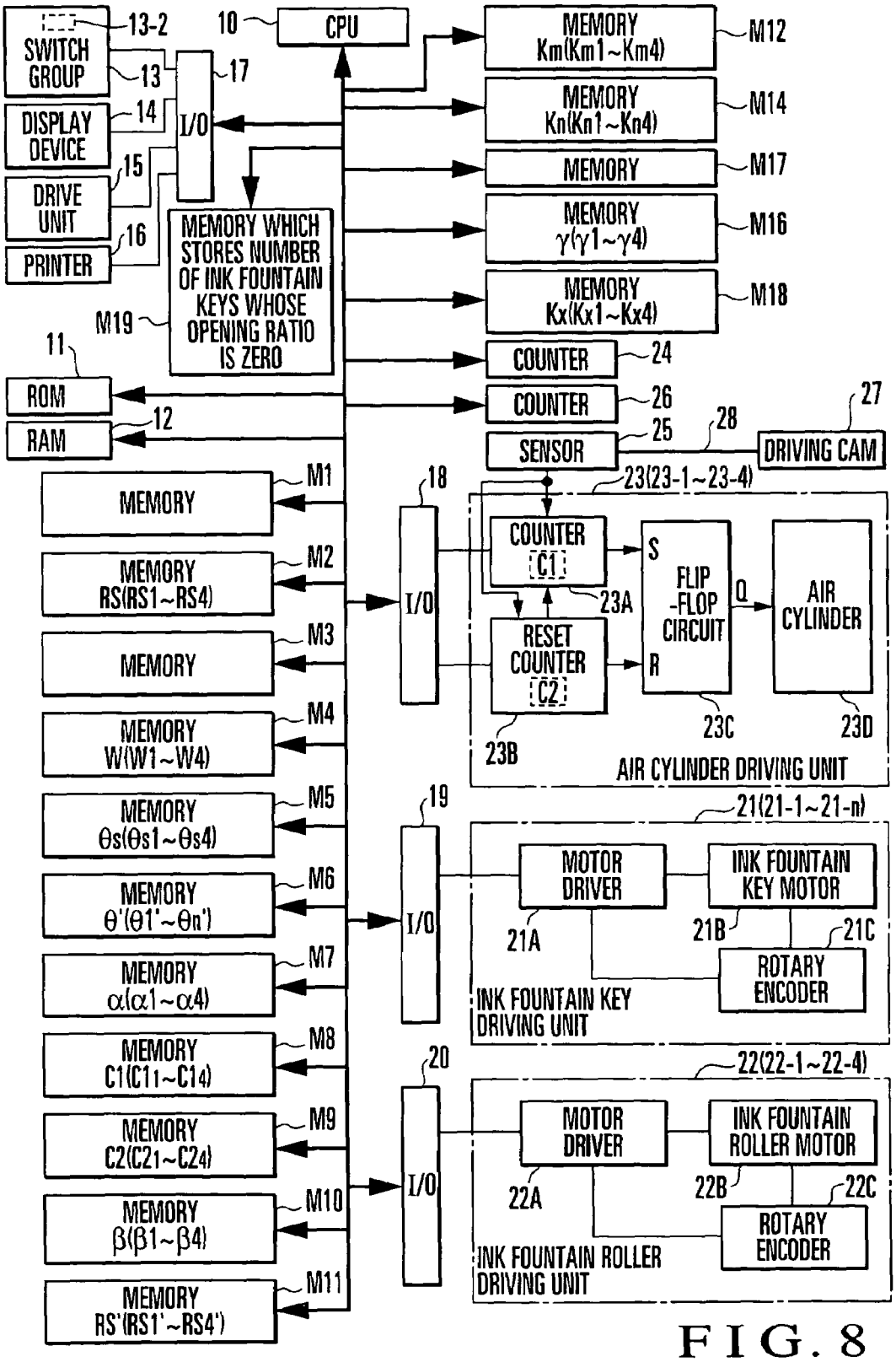
FIG. 8 is a block diagram of an ink supply amount control apparatus for a printing press according to the third embodiment of the present invention.

FIG. 8 shows an ink supply amount control apparatus to which the above-described method (method ②) that uses image data is applied. The same reference numerals as in FIG. 5 denote the same or similar constituent elements in FIG. 8, and a description thereof will be omitted. In the third embodiment, instead of the memory M15 which stores the ratio of small image portions to the total number of ink fountain keys in each printing unit in the second embodiment, a memory M17 which stores the ratio of small image portions to the number of ink fountain keys to be used for printing in each printing unit, a memory M18 which stores the number of ink fountain keys to be used for printing in each printing unit, and a memory M19 which stores the number of ink fountain keys whose opening ratio is zero are arranged. A counter 26 which counts the number of ink fountain keys whose opening ratio is zero is also arranged.

[Determination of Necessity of Intermittent Stop of Ink Feed Operation]

Figure 9A:
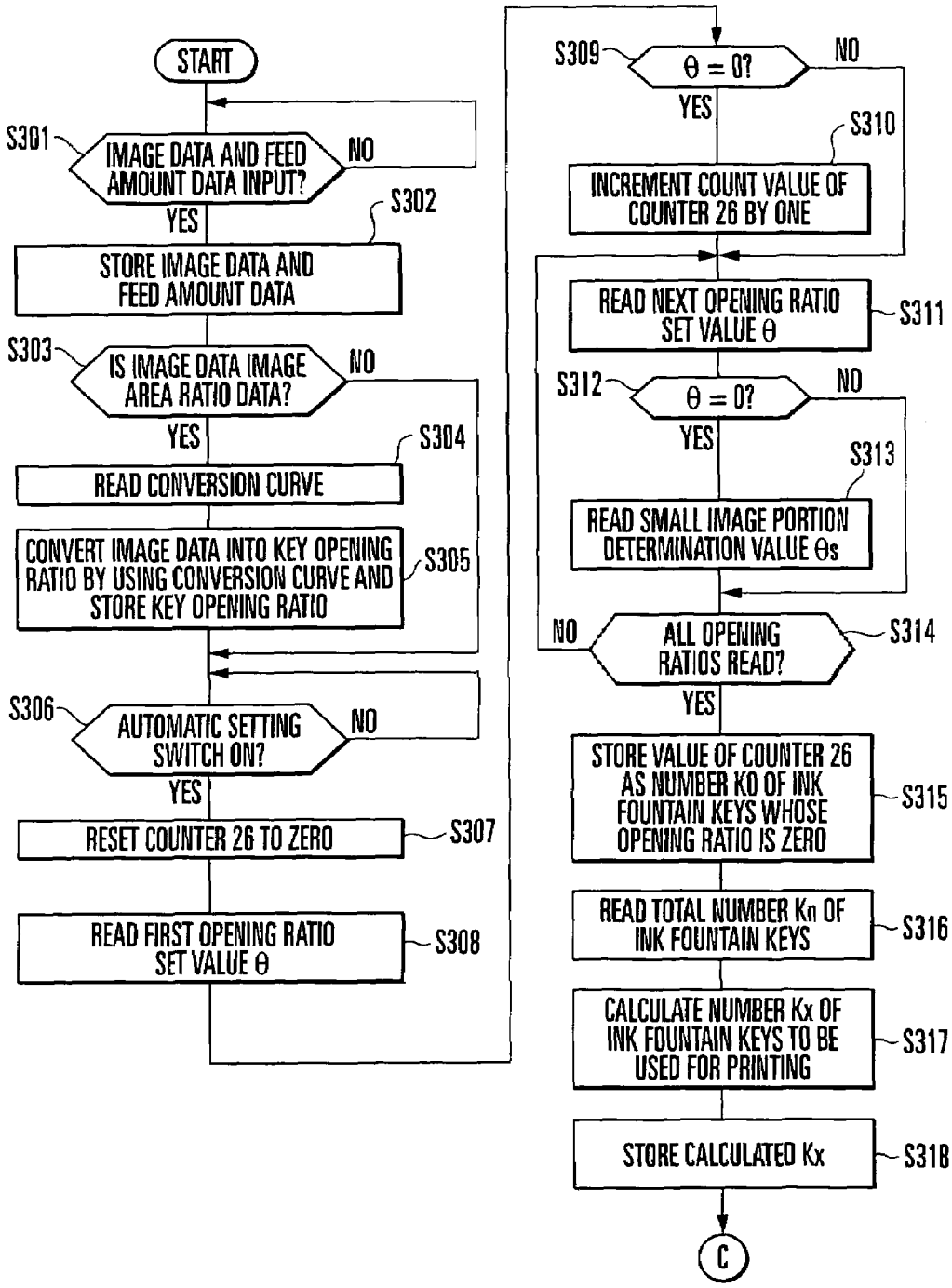
FIGS. 9A and 9B are flow charts for explaining the operation (operation example 1) of the ink supply amount control apparatus shown in FIG. 8 before the start of printing.
Figure 9B:
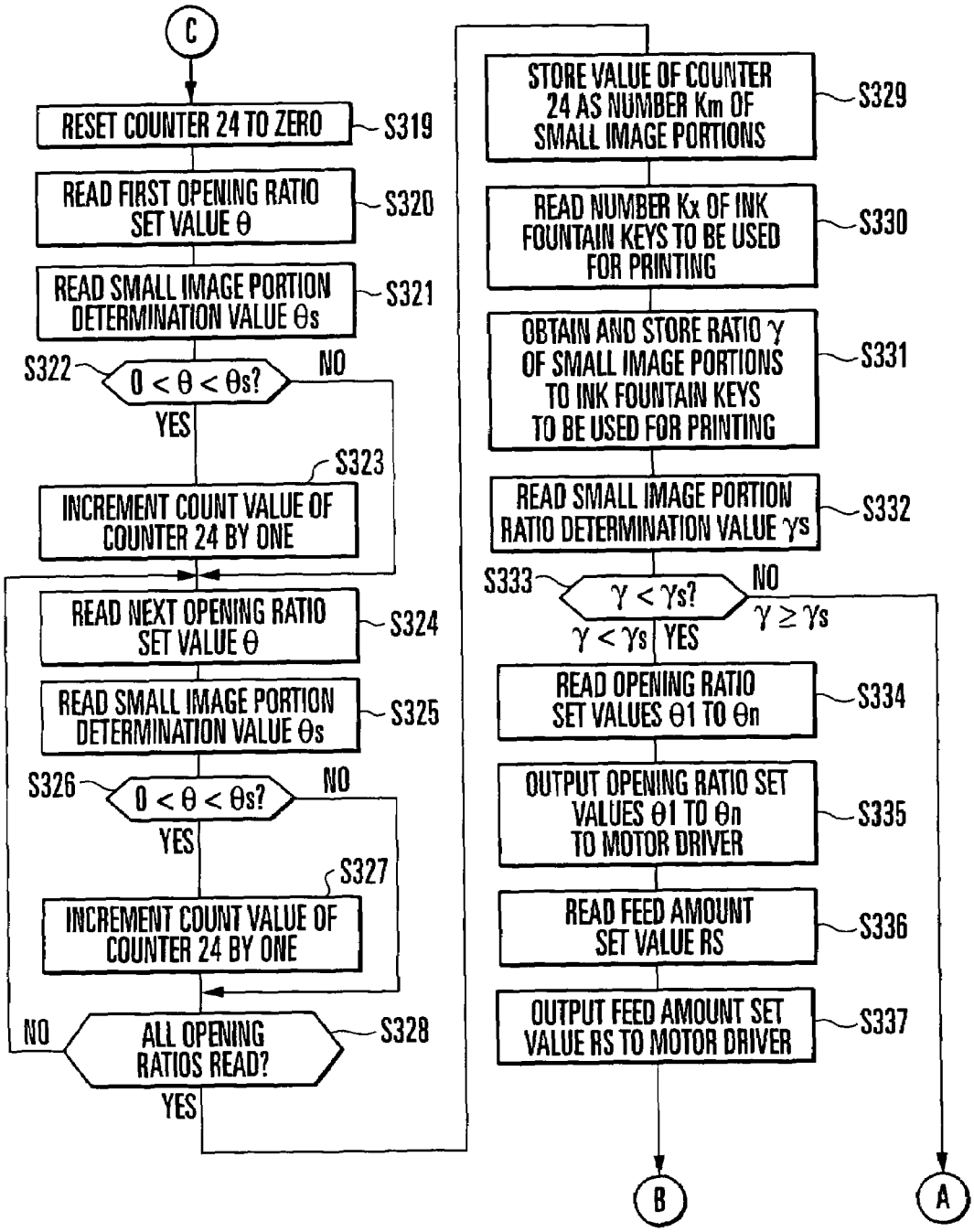

The operation of determining whether intermittent stop of the ink feed operation in the ink supply amount control apparatus should be executed will be described with reference to FIGS. 9A and 9B. The operation in steps S301 to S306 in FIG. 9A is the same as in steps S201 to S206 in FIG. 6A, and a description thereof will be omitted.

When an automatic setting switch 13-2 is turned on by the operator (YES in step S306), a CPU 10 resets the count value of the counter 26 to zero (step S307) and reads out a first ink fountain key opening ratio set value θ1 from a memory M1 (step S308). It is checked whether the ink fountain key opening ratio set value θ1 is not zero (step S309). If θ1=0, the count value of the counter 26 which counts the number of ink fountain keys whose opening ratio is zero is incremented by one (step S310). If θ1≠0, the flow immediately advances to step S311.

In step S311, the CPU 10 reads out the next ink fountain key opening ratio set value θ2 from the memory M1. The CPU 10 checks whether the ink fountain key opening ratio set value θ2 is not zero (step S312). If θ2=0, the count value of the counter 26 which counts the number of ink fountain keys whose opening ratio is zero is incremented by one (step S313). If θ2≠0, the flow immediately advances to step S314.

In the same way, the CPU 10 repeats the operation in steps S311 to S313 until the read of all ink fountain key opening ratio set values θ from the memory M1 is confirmed (step S314). With this operation, the counter 26 counts, of ink fountain keys 4, the number of ink fountain keys whose opening ratio set value θ is determined as zero. The CPU 10 writes the value counted by the counter 26 in the memory M19 as a number K0 of ink fountain keys whose opening ratio is zero (step S315)

Next, the CPU 10 reads out the total number Kn of ink fountain keys of a printing unit 9 from the memory M14 (step S316). The number K0 of ink fountain keys whose opening ratio is zero, which is obtained in step S315, is subtracted from the readout total number Kn of ink fountain keys in the printing unit 9, thereby calculating the number Kx of ink fountain keys to be used for printing (step S317). The calculated number Kx of ink fountain keys is written in the memory M18 (step S318).

Next, the CPU 10 resets the count value of a counter 24 to zero (step S319). The CPU 10 reads out the first ink fountain key opening ratio set value θ1 from the memory M1 and a small image portion determination value θs from a memory M5 (steps S320 and S321). The CPU 10 checks whether the ink fountain key opening ratio set value θ1 satisfies 0<θ1<θs (step S322). If YES in step S322, the count value of the small image portion counter 24 is incremented by one (step S323). If NO in step S322, the flow immediately advances to step S324.

More specifically, if 0<θ1<θs, the area of a printing plate 7, which corresponds to an ink fountain key 4-1, is determined as a small image portion. The count value of the small image portion counter 24 is incremented by one. If 0<θ1<θs is not satisfied, the area of the printing plate 7, which corresponds to the ink fountain key 4-1, is determined as a large/medium image portion or a portion that is not used for printing. The flow immediately advances to step S324 without incrementing the count value of the small image portion counter 24.

In step S324, the CPU 10 reads out the next ink fountain key opening ratio set value θ2 from the memory M1. The CPU 10 also reads out the small image portion determination value θs from the memory M5 (step S325). The CPU 10 checks whether the ink fountain key opening ratio set value θ2 satisfies 0<θ2<θs (step S326). If YES in step S326, the count value of the small image portion counter 24 is incremented by one (step S327). If NO in step S326, the flow immediately advances to step S328.

In the same way, the CPU 10 repeats the operation in steps S324 to S327 until the read of all ink fountain key opening ratio set values θ from the memory M1 is confirmed (step S328). With this operation, the small image portion counter 24 counts the number of ink fountain keys (the number of small image portions), of the ink fountain keys 4, which are determined as small image portions because the opening ratio set values θ satisfy 0<θ<θs. The CPU 10 writes in a memory M12 as Km the number of small image portions counted by the small image portion counter 24 (step S329) and reads out the number Kx of ink fountain keys to be used for printing in the printing unit 9 from the memory M18 (step S330).

The CPU 10 obtains a ratio γ (γ=Km/Kx) of small image portions to the number of ink fountain keys to be used for printing in the printing unit 9 from the number Km of small image portions read out from the memory M12 and the number Kx of ink fountain keys to be used for printing, which is read out from the memory M18. The CPU 10 writes the obtained ratio γ of small image portions to the number of ink fountain keys to be used for printing in a memory M16 (step S331).

The CPU 10 reads out a small image portion ratio determination value γs of the printing unit 9 from the memory M17 (step S332) and compares the readout small image portion ratio determination value γs with the ratio γ of small image portions to the number of ink fountain keys to be used for printing, which is obtained in step S331 (step S333).

If γ<γs, it is determined that the printing plate 7 set on a plate cylinder 8 in the printing unit 9 has a small number of small image portions, and intermittent stop of the ink feed operation is unnecessary. In this case, by the processing operations in steps S334 to S337 corresponding to steps S222 to S225 in FIG. 6A, the opening ratios of the ink fountain keys 4 are adjusted to the normal set values θ1 to θn. In addition, the feed amount of an ink fountain roller 3 at the time of printing is adjusted to a normal set value RS. The series of processing operations are thus ended.

To the contrary, if γ≧γs, it is determined that the printing plate 7 set on the plate cylinder 8 in the printing unit 9 has a large number of small image portions, and intermittent stop of the ink feed operation is necessary. In this case, the CPU 10 adjusts the opening ratios of the ink fountain keys 4 to correction values θ1' to θn' by the processing operations (operation example 1) corresponding to steps S226 to S248 in FIG. 6B. Alternatively, the feed amount of the ink fountain roller 3 at the time of printing is adjusted to a correction value RS' by the processing operations (operation example 2) corresponding to steps S249 to S260 in FIG. 7.

Fourth Embodiment

Automatic Method

In the automatic method described in the first embodiment, the opening ratio set value θ of the ink fountain key 4 or the feed amount set value RS of the ink fountain roller 3 is corrected. In the automatic method according to the fourth embodiment, instead of correcting these values, an actual value θpv of the opening ratio of an ink fountain key 4 or an actual value RSpv of the feed amount of an ink fountain roller 3 is corrected.

Figure 10:
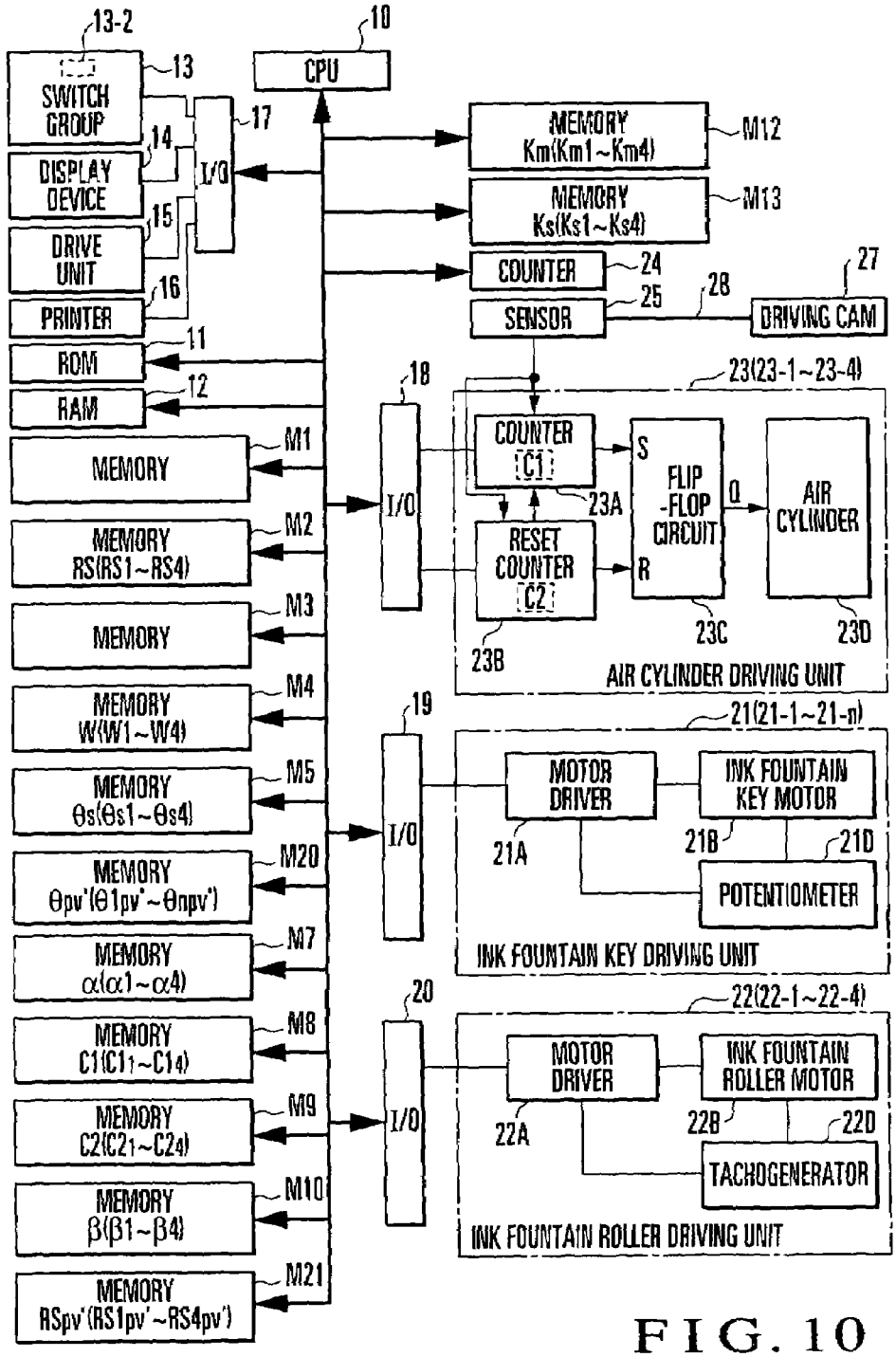
FIG. 10 is a block diagram of an ink supply amount control apparatus for a printing press according to the fourth embodiment of the present invention.

In the ink supply amount control apparatus according to the fourth embodiment shown in FIG. 10, the number of ink fountain keys whose actual value θpv of the ink fountain key opening ratio is smaller than a small image portion determination value θs is counted. When the counted number of ink fountain keys is larger than Ks, it is determined that the number of times of ink feed operation must be thinned.

Referring to FIG. 10, a potentiometer 21D replaces the rotary encoder 21C of the ink fountain key driving unit 21 shown in FIG. 1, and a tachogenerator 22D replaces the rotary encoder 22C of the ink fountain roller driving unit 22.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 11A and 11B. The same operation is executed in all printing units 9, and the operation in one printing unit 9 will be described here.

[Read and Storage of Image Data and Feed Amount Data]

Figure 11A:
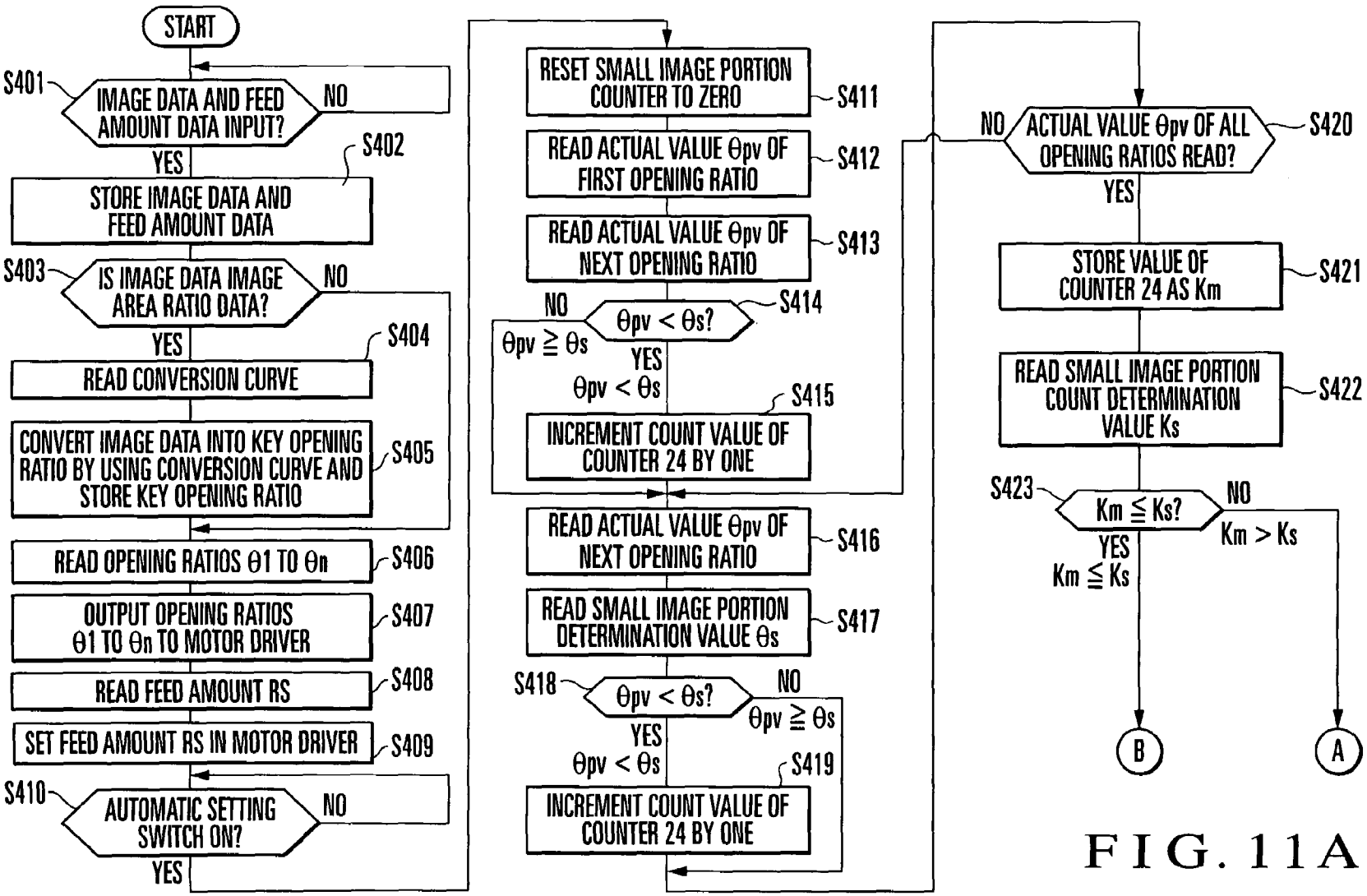
FIGS. 11A and 11B are flow charts for explaining the operation (operation example 1) of the ink supply amount control apparatus shown in FIG. 10 before the start of printing.
Figure 11B:
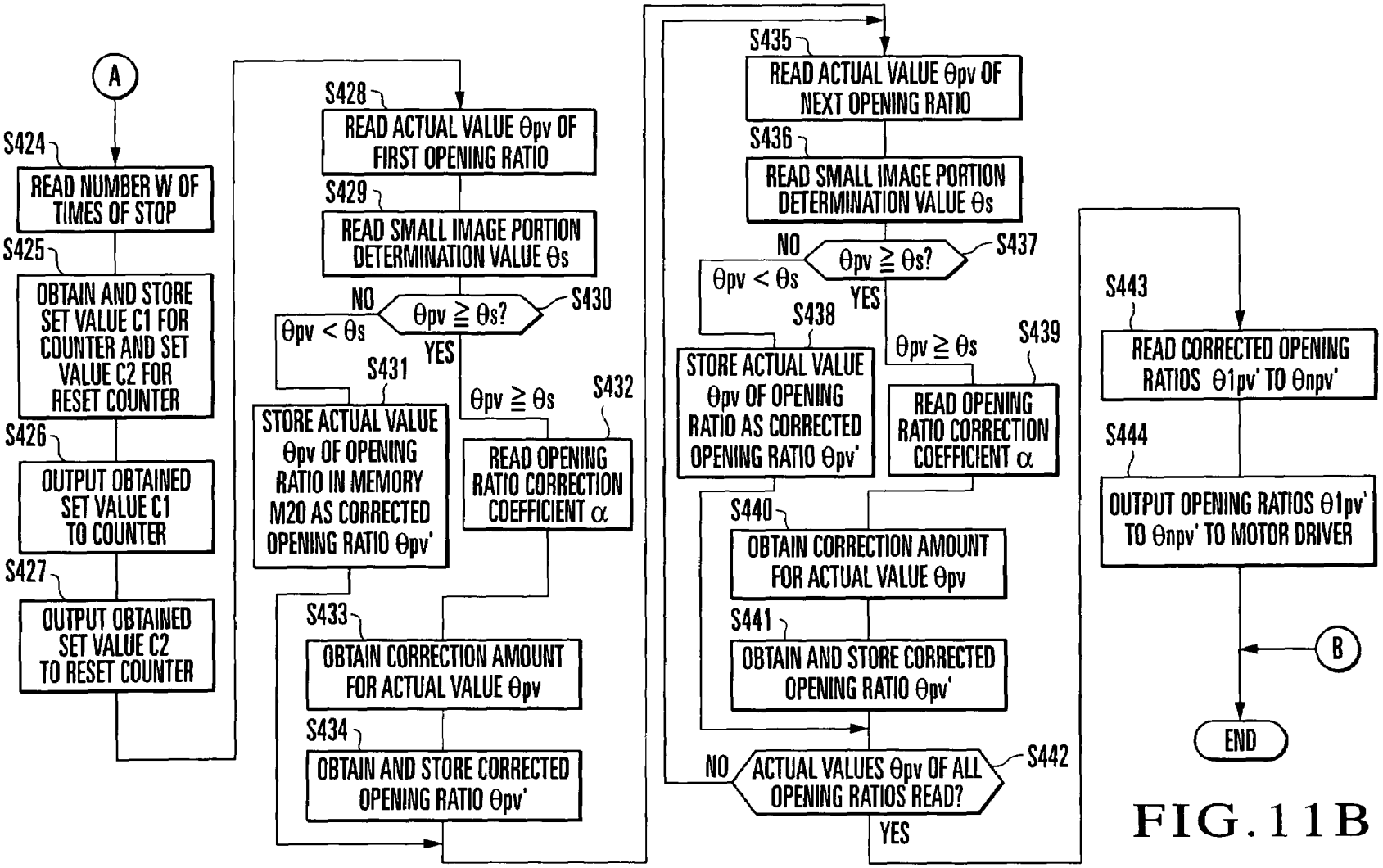

Even in the fourth embodiment, ink fountain key opening ratio set values θ1 to θn are stored in a memory M1, and an ink fountain roller feed amount set value RS is set in a memory M2 by processing operations in steps S401 to S405 in FIG. 11A, which correspond to steps S101 to S105 in FIG. 2A.

The ink fountain key opening ratio set values θ1 to θn are read out from the memory M1 (step S406) and sent to an ink fountain key motor driver 21A of an ink fountain key driving unit 21 (step S407). Accordingly, an ink fountain key motor 21B is driven to adjust the opening ratios of the ink fountain keys 4 in the printing unit 9 to the set values θ1 to θn.

Next, a CPU 10 reads out the ink fountain roller feed amount set value RS from the memory M2 (step S408) and sends the readout ink fountain roller feed amount set value RS to an ink fountain roller motor driver 22A of an ink fountain roller driving unit 22 (step S409). Accordingly, at the time of printing, the feed amount of the ink fountain roller 3 in the printing unit 9 is adjusted to the set value RS.

[Determination of Necessity of Intermittent Stop of Ink Feed Operation]

It is subsequently determined in the following manner whether intermittent stop of the ink feed operation should be executed. The CPU 10 determines whether an automatic setting switch 13-2 in a switch group 13 is turned on (step S410). When the operator presses the automatic setting switch 13-2, the CPU 10 resets the count value of a small image portion counter 24 to zero (step S411).

The CPU 10 reads an actual value θ1pv of the ink fountain key opening ratio from the potentiometer 21D of the first ink fountain key (step S412). The CPU 10 also reads out the small image portion determination value θs from a memory M5 (step S413). The actual value θ1pv of the ink fountain key opening ratio is compared with the small image portion determination value θs (step S414). If θ1pv<θs, the count value of the small image portion counter 24 is incremented by one (step S415). If θ1pv≧θs, the flow immediately advances to step S416.

More specifically, if θ1pv<θs, the area of a printing plate 7, which corresponds to an ink fountain key 4-1, is determined as a small image portion. The count value of the small image portion counter 24 is incremented by one. If θ1pv≧θs, the area of the printing plate 7, which corresponds to the ink fountain key 4-1, is determined as a large/medium image portion. The flow immediately advances to step S416 without incrementing the count value of the small image portion counter 24.

In step S416, the CPU 10 reads an actual value θ2pv of the ink fountain key opening ratio from the potentiometer 21D of the next ink fountain key. The CPU 10 also reads out the small image portion determination value θs from the memory M5 (step S417). The CPU 10 compares the actual value θ2pv of the ink fountain key opening ratio with the small image portion determination value θs (step S418). If θ2pv<θs, the area is determined as a small image portion, as in step S415, and the count value of the small image portion counter 24 is incremented by one (step S419). If θ2pv≧θs, the area is determined as a large/medium image portion, and the flow immediately advances to step S420.

In the same way, the CPU 10 repeats the operation in steps S416 to S420 until the read of the actual values θpv of the ink fountain key opening ratios from the potentiometers 21D of all ink fountain keys is confirmed (step S420). With this operation, the counter 24 counts the number of ink fountain keys (the number of small image portions), of all the ink fountain keys 4, which are determined as small image portions because the actual values θpv of the opening ratios are smaller than θs.

The CPU 10 writes a number Km of small image portions counted by the small image portion counter 24 in the memory M12 (step S421). The CPU 10 reads out the small image portion count determination value Ks from a memory M13 (step S422) and compares the number Km of small image portions with the small image portion count determination value Ks (step S423).

If Km≦Ks, the CPU 10 determines that the printing plate 7 set on a plate cylinder 8 in the printing unit 9 has a small number of small image portions, and intermittent stop of the ink feed operation is unnecessary. The series of processing operations are thus ended.

To the contrary, if Km>Ks, the CPU 10 determines that the printing plate 7 set on the plate cylinder 8 in the printing unit 9 has a large number of small image portions, and intermittent stop of the ink feed operation is necessary.

In this case, the CPU 10 reads out a number W of times of stop from a memory M4 (step S424). Set values C1 and C2 are set for a counter 23A and reset counter 23B in an air cylinder driving unit 23 by the processing operations in steps S425 to S427 corresponding to steps S125 to S127 in FIG. 2B to prepare for intermittent stop of the ink feed operation of an ink ductor roller 5 in the printing unit 9.

[Ink Fountain Key Opening Ratio Correction]

The CPU 10 reads an actual value θ1pv of the ink fountain key opening ratio from the potentiometer 21D of the first ink fountain key (step S428). The CPU 10 also reads out the small image portion determination value θs from the memory M5 (step S429). The CPU 10 compares the read actual value θ1pv of the ink fountain key opening ratio with the small image portion determination value θs (step S430). If θ1pv<θs, the flow advances to step S431. If θ1pv≧θs, the flow advances to step S432.

If θ1pv<θs, the area of the printing plate 7, which corresponds to the ink fountain key 4-1, is determined as a small image portion. The actual value θ1pv of the ink fountain key opening ratio, which is read from the potentiometer 21D, is directly written in the memory M20 as θ1pv' (step S431).

If θ1pv≧θs, the area of the printing plate 7, which corresponds to the ink fountain key 4-1, is determined as a large/medium image portion. A correction coefficient α is read out from a memory M7 (step S432). The actual value θ1pv of the ink fountain key opening ratio, which is read from the potentiometer 21D, is multiplied by the correction coefficient α to obtain a correction amount for the actual value θ1pv (step S433).

The correction amount is added to the actual value θ1pv to obtain an ink fountain key opening ratio correction value θ1pv' and writes it in the memory M20 (step S434). With this operation, the actual value θ1pv of the opening ratio of the ink fountain key 4-1 whose corresponding area is determined as a large/medium image portion is corrected such that it increases by the product of the actual value θ1pv and the correction coefficient α.

The CPU 10 reads the actual value θ2pv of the ink fountain key opening ratio from the potentiometer 21D of the next ink fountain key (step S435). The CPU 10 also reads out the small image portion determination value θs from the memory M5 (step S436). The CPU 10 compares the actual value θ2pv of the ink fountain key opening ratio with the small image portion determination value θs (step S437). If θ2pv<θs, the actual value θ2pv is directly written in the memory M20 as θ2pv', as in step S431 (step S438).

If θ2pv≧θs, as in steps S432 to S434, the correction coefficient α is read out from the memory M7 (step S439). The actual value θ2pv is multiplied by the correction coefficient α to obtain a correction amount (step S440). A value obtained by adding the correction amount to the actual value θ2pv is written in the memory M20 as θ2pv' (step S441).

In the same way, the CPU 10 repeats the operation in steps S435 to S441 until the read of the actual values θpv of the ink fountain key opening ratios from the potentiometers 21D of all ink fountain keys is confirmed (step S442). With this operation, the ink fountain key opening ratio correction values θ1pv' to θnpv' are stored in the memory M20.

The ink fountain key opening ratio correction values θ1pv' to θnpv' stored in the memory M20 are not actually corrected when the actual value θpv is smaller than the small image portion determination value θs. The opening ratio correction values θ1' to θn' are corrected when the actual value θpv is larger than the small image portion determination value θs. That is, the actual values θ1 to θn of the opening ratios of the ink fountain keys 4 are not corrected when the corresponding area is a small image portion (θpv<θs). Only for a large/medium image portion (θpv≧θs), the actual values θ1 to θn are corrected to larger values.

When storage of the ink fountain key opening ratio correction values θ1pv' to θnpv' in the memory M20 is ended in step S442, the CPU 10 reads out the ink fountain key opening ratio correction values θ1pv' to θnpv' from the memory M20 (step S443). The readout ink fountain key opening ratio correction values θ1pv' to θnpv' are sent to the motor driver 21A of the ink fountain key driving unit 21 (step S444). The ink fountain key motor 21B is driven to adjust the opening ratios of the ink fountain keys 4 in the printing unit 9 to the correction values θ1pv' to θnpv'.

OPERATION EXAMPLE 2

Intermittent Stop+Ink Fountain Roller Feed Amount Correction

In operation example 1 described above, when the ink feed operation should intermittently be stopped, the actual values θ1pv to θnpv of the ink fountain key opening ratios are corrected in accordance with the image area ratio. In place of the actual values θ1pv to θ npv of the ink fountain key opening ratios, the actual value RSpv of the feed amount of the ink fountain roller 3 may be corrected in accordance with the image area ratio.

In operation example 2 to be described with reference to FIG. 12, the actual value RS of the feed amount of the ink fountain roller 3 is corrected to a larger value. With this operation, the ink supply amount to the large/medium image portion that requires a higher ink fountain key opening ratio is increased as compared to a small image portion that requires a low ink fountain key opening ratio.

Figure 12:
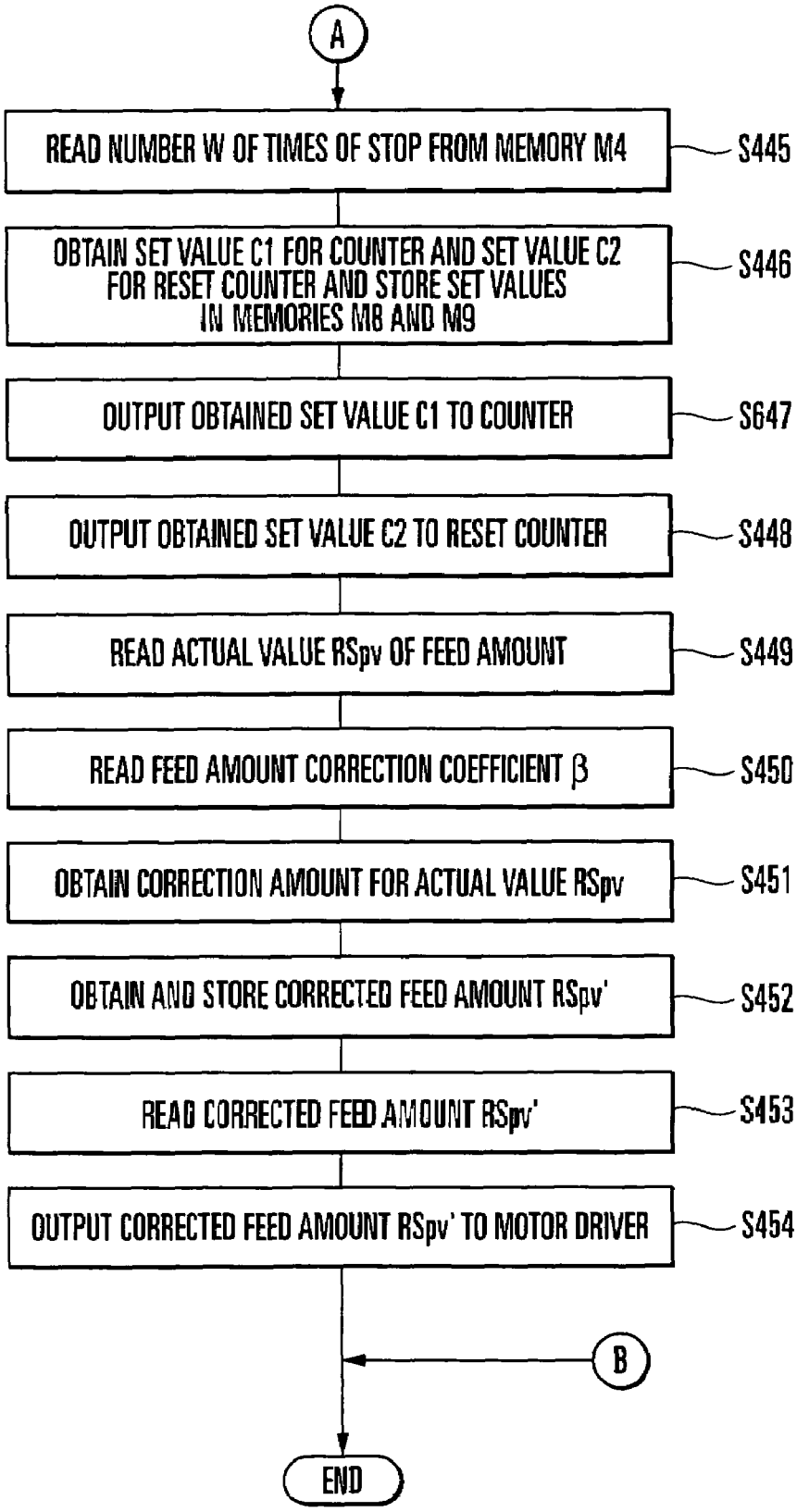
FIG. 12 is a flow chart for explaining the operation (operation example 2) of the ink supply amount control apparatus shown in FIG. 10 before the start of printing.

FIG. 12 follows processing that is executed after NO in step S423 in FIG. 11A. The operation until step S423 is the same as in operation example 1, and a description thereof will be omitted.

When it is confirmed in step S423 that Km>Ks, it is determined that the printing plate 7 set on the plate cylinder 8 in a printing unit 9-1 has a large number of small image portions, and intermittent stop of the ink feed operation is necessary.

In this case, the CPU 10 reads out the number W of times of stop from the memory M4 (step S445), obtains the set value C1 for the counter 23A in the air cylinder driving unit 23 and the set value C2 for the reset counter 23B from the number W of times of stop, and writes the set values in memories M8 and M9 (step S446). The set value C1 is set for the counter 23A, and the set value C2 is set for the reset counter 23B (steps S447 and S448).

The CPU 10 reads the actual value RSpv of the ink fountain roller feed amount from the tachogenerator 22D (step S449). The CPU 10 also reads out a correction coefficient β from a memory M10 (step S450) The CPU 10 multiplies the actual value RSpv of the ink fountain roller feed amount, which is read from the tachogenerator 22D, by the correction coefficient θ to obtain the correction amount for the actual value RSpv (step S451). Next, the CPU 10 adds the correction amount to the actual value RSpv of the ink fountain roller feed amount, which is read from the tachogenerator 22D, to obtain an ink fountain roller feed amount correction value RSpv' and writes it in the memory M21 (step S452). Accordingly, the actual value RSpv of the feed amount of the ink fountain roller 3 is corrected to be larger by the product of the actual value RSpv and the correction coefficient β.

The CPU 10 reads out the ink fountain roller feed amount correction value RSpv' from the memory M21 (step S453). The readout ink fountain roller feed amount correction value RSpv' is sent to the motor driver 22A of the ink fountain roller driving unit 22 (step S454). Accordingly, at the time of printing, the feed amount of the ink fountain roller 3 in the printing unit 9 is adjusted to the correction value RSpv'.

Figure 13:
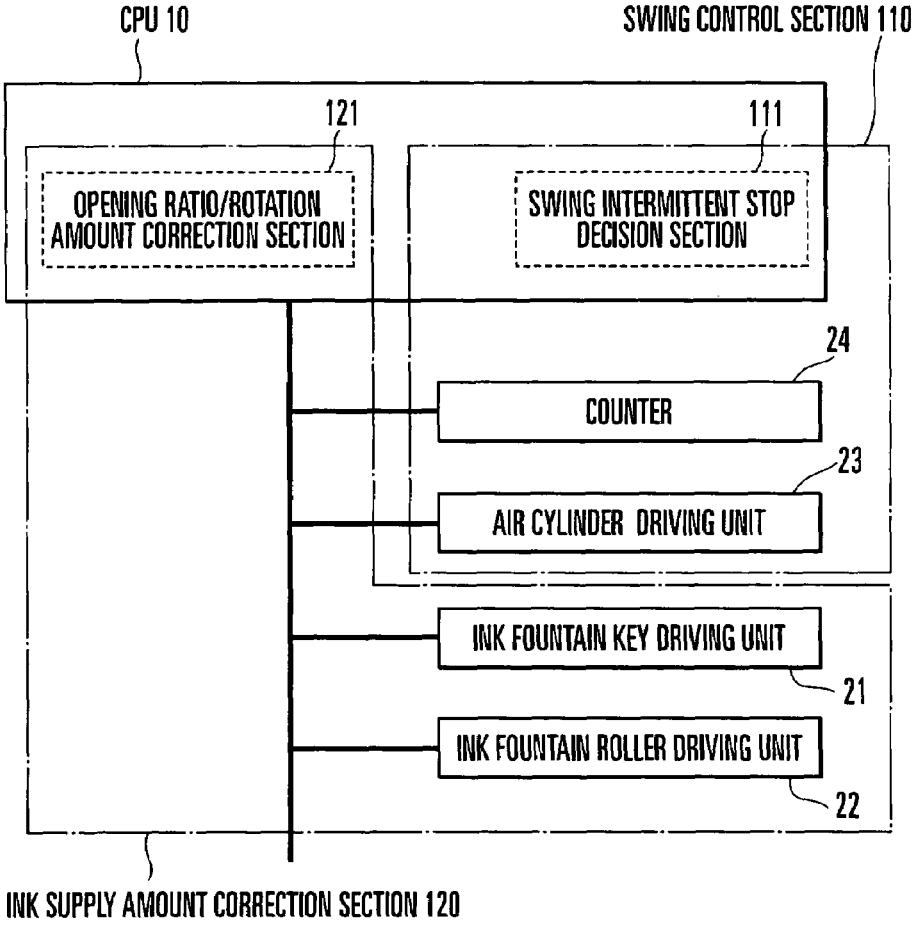
FIG. 13 is a block diagram of a swing control section and ink supply amount correction section including the functional blocks of a CPU.

In the above-described first to fourth embodiments, as shown in FIG. 13, the CPU 10 has, as functional blocks, a swing intermittent stop decision section 111 and opening ratio/rotation amount correction section 121. The decision section 111 decides on the basis of the count value of the counter 24 whether intermittent stop of the swing operation of the ink ductor roller is necessary and controls the operation of the air cylinder driving unit 23 (step S119 in FIG. 2A). The air cylinder 23, counter 24, and decision section 111 construct a swing control section which controls the swing operation (including intermittent stop) of the ink ductor roller.

Figure 2B:
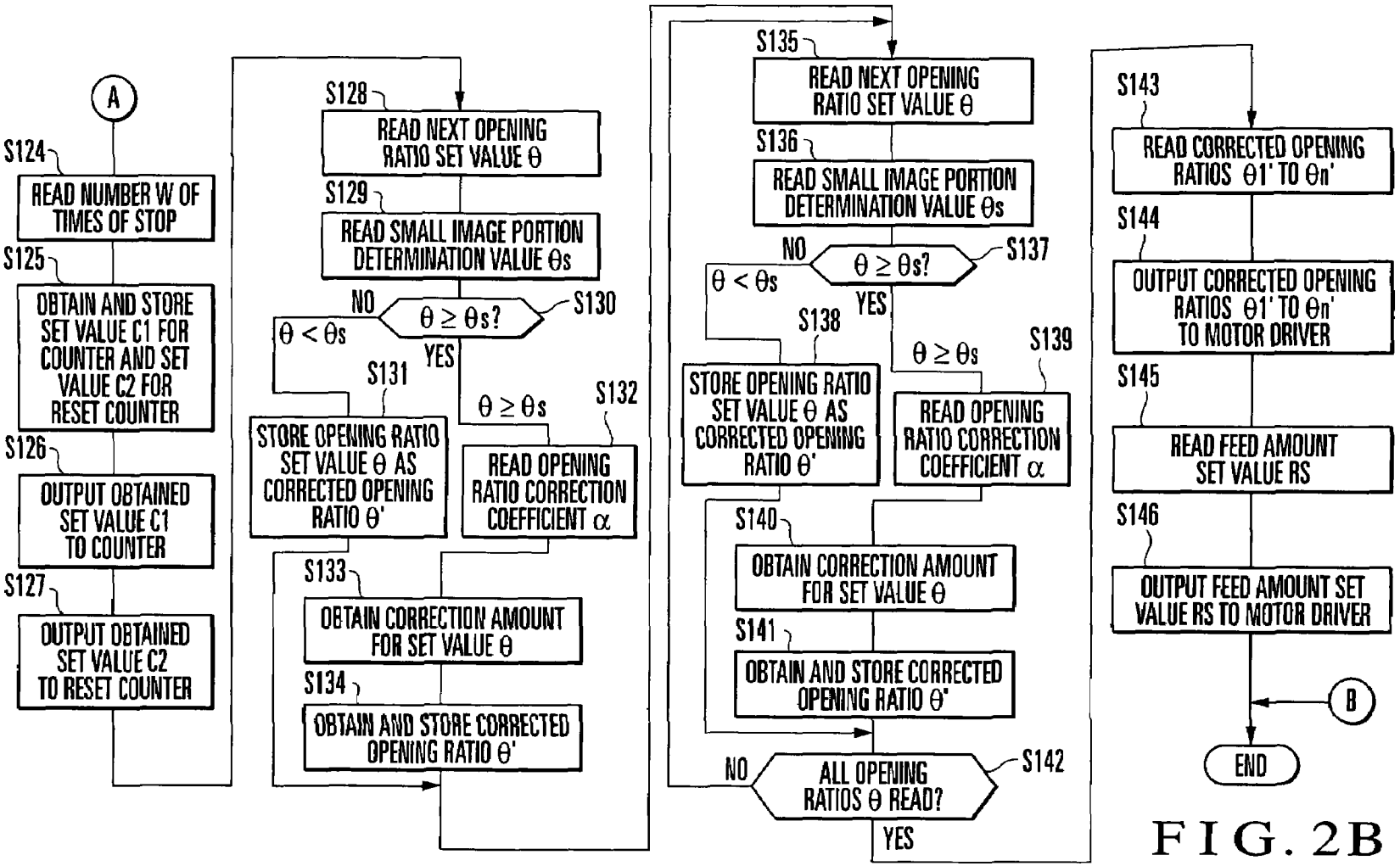

The opening ratio/rotation amount correction section 121 controls one of the ink fountain key driving unit 21 and ink fountain roller driving unit 22 on the basis of the image area ratio of the printing plate (steps S130 to S146 in FIG. 2B). The ink fountain key driving unit 21, ink fountain roller driving unit 22, and opening ratio/rotation amount correction section 121 construct an ink supply amount correction section 120 which corrects the opening ratio of each ink fountain key or the rotation amount of the ink fountain roller to correct the ink supply amount.

In the above-described first to fourth embodiments, the ink ductor roller 5 is arranged between the ink fountain roller 3 and the ink rollers 6-1. However, one of rollers from the ink fountain roller 3 to the ink form rollers 6-2 may serve as the ink ductor roller that performs the swing operation, and the swing operation of the ink ductor roller may be intermittently stopped.

In the operation example 1, the means (driving cam 27) for periodically swinging the ink ductor roller 5 as the printing press rotates and the means (air cylinder driving unit 23) for stopping the swing operation are formed from separate members (mechanisms). However, the present invention is not limited to this. These means may be formed from an integrated member (mechanism).

As has been described above, according to the present invention, the ink ductor roller swing intermittent stop means is actuated on the basis of the number of ink fountain keys whose gap amount with respect to the ink fountain roller falls within a predetermined range. With this arrangement, it can automatically be determined whether intermittent stop of the ink feed operation should be executed so that the load on the operator can be reduced.

What is claimed is:

1. An ink supply amount control method for a printing press, comprising the steps of:

counting the number of ink fountain keys whose gap amount with respect to an ink fountain roller falls within a predetermined range;

controlling, on the basis of a count value of the ink fountain keys, a swing operation of an ink ductor roller which is arranged in an ink supply path and swings in synchronism with rotation of the printing press;

supplying ink from a gap between the plurality of ink fountain keys and the ink fountain roller to the ink supply path in accordance with rotation of the ink fountain roller at the time of printing; and supplying the ink to a printing plate attached to a plate cylinder through the ink supply path by the swing operation of the ink ductor roller.

2. A method according to claim 1, wherein the control step comprises the step of deciding on the basis of the count value of the ink fountain keys whether the swing operation of the ink ductor roller should intermittently be stopped.

3. A method according to claim 2, wherein the decision step comprises the step of intermittently stopping the swing operation of the ink ductor roller when the count value of the ink fountain keys is larger than a predetermined value.

4. A method according to claim 2, wherein the decision step comprises the steps of obtaining a ratio of the count value of the ink fountain keys to the total number of ink fountain keys, and when the obtained ratio is more than a preset value, intermittently stopping the swing operation of the ink ductor roller.

5. A method according to claim 2, wherein the decision step comprises the steps of obtaining a ratio of the count value of the ink fountain keys to the number of ink fountain keys to be used for printing, and when the obtained ratio is more than a preset value, intermittently stopping the swing operation of the ink ductor roller.

6. A method according to claim 2, further comprising the step of, when the swing operation of the ink ductor roller is intermittently stopped, controlling at least one of the ink fountain key and the ink fountain roller to control an ink supply amount to the ink ductor roller.

7. A method according to claim 6, wherein the control step comprises the step of correcting the gap amount between the ink fountain key and the ink fountain roller.

8. A method according to claim 6, wherein the control step comprises the step of correcting a rotation amount of the ink fountain roller.

9. A method according to claim 6, wherein the control step comprises the step of controlling at least one of the ink fountain key and the ink fountain roller on the basis of an image area ratio of the printing plate.

10. An ink supply amount control apparatus for a printing press, comprising:

a plurality of ink fountain keys which are juxtaposed;

an ink fountain roller which is rotatably arranged near said ink fountain keys, said ink fountain roller rotating to supply ink from a gap between said ink fountain keys and said ink fountain roller to an ink supply path;

an ink ductor roller which is arranged in the ink supply path to freely swing and supplies the ink to a printing plate on a plate cylinder by a swing operation;

swing driving means for swinging said ink ductor roller in synchronism with rotation of the printing press; and swing control means for controlling an operation of said swing driving means on the basis of the number of ink fountain keys whose gap amount with respect to said ink fountain roller falls within a predetermined range.

11. An apparatus according to claim 10, wherein said swing control means comprises count means for counting the number of ink fountain keys whose gap amount with respect to said ink fountain roller falls within the predetermined range, and decision means for deciding on the basis of the count value of the ink fountain keys by said count means whether the swing operation of said ink ductor roller should intermittently be stopped.

12. An apparatus according to claim 11, wherein said decision means intermittently stops the swing operation of said ink ductor roller when the counted number of the ink fountain keys is larger than a predetermined number.

13. An apparatus according to claim 11, wherein said decision means intermittently stops the swing operation of said ink ductor roller when a ratio of the count value of said ink fountain keys to the total number of ink fountain keys is more than a preset ratio.

14. An apparatus according to claim 11, wherein said decision means intermittently stops the swing operation of said ink ductor roller when a ratio of the count value of said ink fountain keys to the number of ink fountain keys to be used for printing is more than a preset value.

15. An apparatus according to claim 11, further comprising correction means for, when the swing operation of said ink ductor roller is intermittently stopped, controlling at least one of said ink fountain key and said ink fountain roller to control an ink supply amount to said ink ductor roller.

16. An apparatus according to claim 15, wherein said correction means corrects the gap amount between said ink fountain key and said ink fountain roller.

17. An apparatus according to claim 15, wherein said correction means corrects a rotation amount of said ink fountain roller.

18. An apparatus according to claim 15, wherein said correction means controls at least one of said ink fountain key and said ink fountain roller on the basis of an image area ratio of the printing plate.

19. A printing press including:

an ink fountain roller;

a plurality of ink fountain keys which are juxtaposed in an axial direction of said ink fountain roller;

an ink ductor roller which is arranged in an ink supply path from said ink fountain roller to a printing plate;

roller swing means for swinging said ink ductor roller in synchronism with rotation of said printing press; and swing stop means for intermittently stopping a swing operation of said ink ductor roller on the basis of an image area ratio of the printing plate, ink supplied from a gap between said ink fountain keys and said ink fountain roller to said ink fountain roller in accordance with rotation of said ink fountain roller being supplied to the printing plate by the swing operation of said ink ductor roller, comprising count means for counting the number of ink fountain keys whose gap amount with respect to said ink fountain roller falls within a predetermined range, and control means for controlling said swing stop means on the basis of a count value of said count means.

* * * * *